US010988928B2

(12) United States Patent
Hirayama et al.

(10) Patent No.: US 10,988,928 B2
(45) Date of Patent: Apr. 27, 2021

(54) STEEL-FRAMED CONCRETE BEAM AND METHOD FOR CONSTRUCTING STEEL-FRAMED CONCRETE BEAM

(71) Applicants: TAKENAKA CORPORATION, Osaka (JP); JFE STEEL CORPORATION, Tokyo (JP); JFE METAL PRODUCTS CORPORATION, Tokyo (JP)

(72) Inventors: Takayuki Hirayama, Osaka (JP); Kazuto Nakahira, Osaka (JP); Hirokazu Nozawa, Hyogo (JP); Yuuichirou Okuno, Nara (JP); Takahiro Machinaga, Fukuoka (JP); Naohiro Fujita, Nara (JP); Hiroto Takatsu, Chiba (JP); Kenji Yamazaki, Tokyo (JP); Yukio Murakami, Chiba (JP); Tomohiro Kinoshita, Kanagawa (JP); Takanori Shimizu, Chiba (JP); Seishi Watanabe, Tokyo (JP); Hiroori Yasuoka, Kanagawa (JP)

(73) Assignees: TAKENAKA CORPORATION, Osaka (JP); JFE STEEL CORPORATION, Tokyo (JP); JFE METAL PRODUCTS CORPORATION, Tokyo (JP)

( * ) Notice: Subject to any disclaimer, the term of this patent is extended or adjusted under 35 U.S.C. 154(b) by 0 days.

(21) Appl. No.: 16/549,198

(22) Filed: Aug. 23, 2019

(65) Prior Publication Data

US 2019/0376289 A1 Dec. 12, 2019

Related U.S. Application Data

(63) Continuation-in-part of application No. PCT/JP2018/005970, filed on Feb. 20, 2018.

(30) Foreign Application Priority Data

Feb. 28, 2017 (JP) ..... JP2017-036749

(51) Int. Cl.
*E04C 3/294* (2006.01)

(52) U.S. Cl.
CPC ..... *E04C 3/294* (2013.01)

(58) Field of Classification Search
CPC . E04C 3/294; E04C 3/293; E04B 5/40; E04B 1/16; E04B 2005/322; E04B 5/23
See application file for complete search history.

(56) References Cited

U.S. PATENT DOCUMENTS 2,233,291 A * 2/1941 Leebov ..... E04B 5/23 52/335
4,125,973 A * 11/1978 Lendrihas ..... E04B 1/165 249/188

(Continued)

FOREIGN PATENT DOCUMENTS

CA 2407253 A1 * 4/2004 ..... E04B 5/40
JP 2570564 9/1992

(Continued)

OTHER PUBLICATIONS

International Preliminary Report on Patentability and Written Opinion in corresponding WIPO Patent Application No. PCT/JP2018/005970, dated Sep. 3, 2019.

*Primary Examiner* — Adriana Fugueroa
(74) *Attorney, Agent, or Firm* — Greenblum & Bernstein, P.L.C.

(57) ABSTRACT

A binding beam includes a steel form having a bottom plate portion and a pair of side plate portions extending upward from both ends of the bottom plate portion and binding beam concrete placed in a groove portion configured by the bottom plate portion and the pair of side plate portions of the steel form.

8 Claims, 13 Drawing Sheets

(56) References Cited

U.S. PATENT DOCUMENTS

| | | | | | |
|---|---|---|---|---|---|
| 4,211,045 | A * | 7/1980 | Koizumi | E04B 1/21 | 52/251 |
| 4,685,264 | A * | 8/1987 | Landis | E04B 5/40 | 249/28 |
| 5,941,035 | A * | 8/1999 | Purse | E04B 5/40 | 52/252 |
| 6,543,195 | B2 * | 4/2003 | Rahimzadeh | E04B 1/165 | 52/320 |
| 2014/0298749 | A1 * | 10/2014 | Manning | E04C 3/293 | 52/649.2 |

FOREIGN PATENT DOCUMENTS

| | | | | | |
|---|---|---|---|---|---|
| JP | 10-140654 | | 5/1998 | | |
| JP | 2002220842 | A * | 8/2002 | | |
| JP | 2011094335 | A * | 5/2011 | | |
| JP | 2014-148813 | | 8/2014 | | |
| TW | 320667 | | 11/1997 | | |
| TW | 370998 | | 9/1999 | | |
| WO | WO-9208018 | A1 * | 5/1992 | E04C 3/293 | |

* cited by examiner

STEEL-FRAMED CONCRETE BEAM AND METHOD FOR CONSTRUCTING STEEL-FRAMED CONCRETE BEAM

CROSS REFERENCE TO RELATED APPLICATIONS

This application is a Continuation-In-Part of PCT/W2018/005970 filed Feb. 20, 2018, and claims the priority benefit of Japanese application 2017-036749 filed on Feb. 28, 2017, the contents of which are expressly incorporated by reference herein in their entireties.

INCORPORATION BY REFERENCE

All publications and patent applications mentioned in this specification are herein incorporated by reference in their entirety to the same extent as if each individual publication or patent application was specifically and individually indicated to be incorporated by reference.

TECHNICAL FIELD

The present invention relates to a steel-framed concrete beam and a method for constructing a steel-framed concrete beam.

BACKGROUND ART

Proposed in the related art is a method for forming a web opening for passing a duct or the like through an RC beam. According to a proposed example of the method, a decline in the proof stress of the beam during web opening formation is suppressed by penetration reinforcement being performed with a reinforcing member attached to the outer shell of the beam, and then the web opening penetrating the beam and the reinforcing member is formed (see, for example, Patent Document 1).

CITATION LIST

Patent Document

Patent Document 1: Japanese Unexamined Patent Application Publication No. 2014-148813

SUMMARY OF THE INVENTION

Technical Problem

According to the method described in the Patent Document 1, the reinforcing member needs to be separately attached to a side surface of the beam after RC beam building for the web opening to be formed, and then an increase in work man-hours arises. Besides, the web opening can be formed only in the range of reinforcing member attachment, and thus the degree of freedom is low in terms of the position and size of the web opening. Desired in this regard are a steel-framed concrete beam and a method for constructing a steel-framed concrete beam allowing a reduction in the labor and cost entailed by separate reinforcing member attachment for web opening formation and allowing enhancement of the degree of freedom in terms of web opening position and size.

It is an object of the present invention to solve the problems of the above mentioned prior arts.

Means for Solving the Problems

One aspect of the present invention provides a steel-framed concrete beam comprises: a steel form having a bottom plate portion and a pair of side plate portions extending upward from both ends of the bottom plate portion; and concrete placed in a groove portion configured by the bottom plate portion and the pair of side plate portions of the steel form.

DESCRIPTION OF EMBODIMENTS

Embodiments of a steel-framed concrete beam according to the invention will be described in detail below with reference to accompanying drawings. The basic concepts of the embodiments ([I]) will be described first, and then details of the embodiments ([II]) will be described. Modification examples regarding the embodiments ([III]) will be described last. The invention is not limited by the embodiments.

[I] BASIC CONCEPTS OF EMBODIMENTS

The basic concepts of the embodiments will be described first.

The embodiments relate to a steel-framed concrete beam constituting a building. The "steel-framed concrete beam" is a beam provided with at least a steel frame and concrete. The steel-framed concrete beam may be provided with a component other than the steel frame and the concrete. For example, the embodiments illustrate an example in which the steel-framed concrete beam is configured as a steel-framed reinforced concrete beam that has a rebar in addition to a steel frame and concrete. Although the steel-framed reinforced concrete beam may be provided with, for example, a main bar and a stirrup as the rebar, a case where the steel-framed reinforced concrete beam is provided with a main bar and no stirrup will be described below. The steel-framed concrete beam may be provided with, for example, a stirrup and no main bar, both a main bar and a stirrup, or no main bar and no stirrup.

The steel frame is capable of having any shape insofar as the steel frame functions as a form allowing concrete placement. A case where the steel frame has an axial cross section in a hat shape (a shape obtained by joining a pair of Z-steels to each other) will be described below.

The steel-framed concrete beam according to the embodiments is applicable to any installation floor. Although a case where the steel-framed concrete beam is a second floor beam will be described below, the steel-framed concrete beam is applicable to beams of other floors as well. Although a case where the steel-framed concrete beam is a binding beam will be described below, the steel-framed concrete beam may be a girder as well.

[II] DETAILS OF EMBODIMENTS

Details of the embodiments will be described below.

Embodiment 1

The steel-framed concrete beam according to Embodiment 1 will be described first.

(Configuration)

Figure 1:
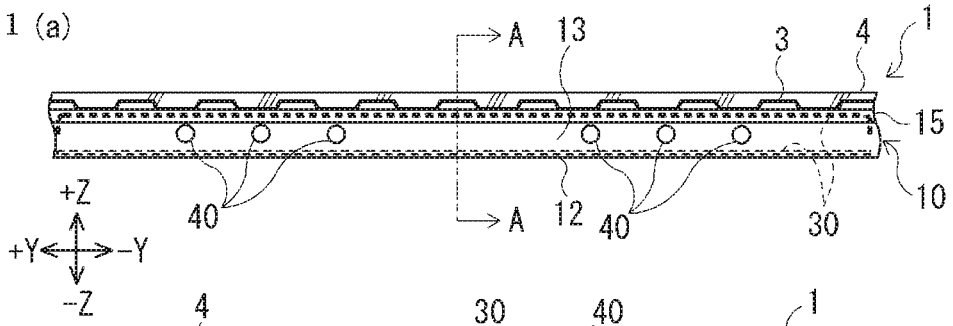
FIGS. 1(*a*) and 1(*b*) are a set of views illustrating a steel-framed concrete beam (binding beam) according to Embodiment 1 of the invention, in which FIG. 1(*a*) is a left side view and FIG. 1(*b*) is a cross-sectional view taken along arrow A-A in FIG. 1(*a*).
Figure 1:
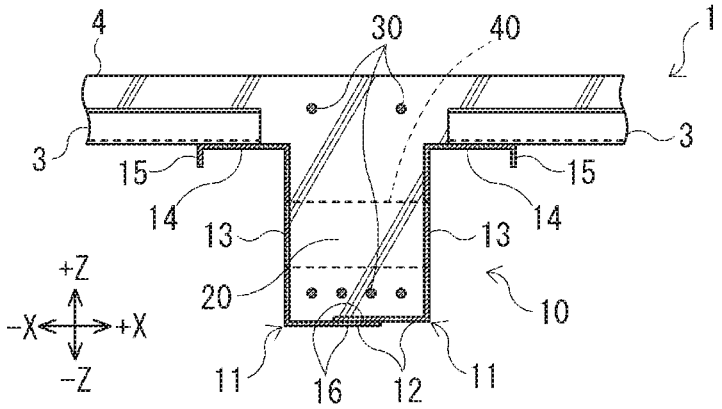

FIG. 1 is a set of views illustrating the steel-framed concrete beam according to Embodiment 1 (hereinafter, simply referred to as "binding beam" 1). FIG. 1(*a*) is a left side view and FIG. 1(*b*) is a cross-sectional view taken along arrow A-A in FIG. 1(*a*). As illustrated in FIG. 1, the binding beam 1 according to Embodiment 1 is provided with a steel form 10, binding beam concrete 20, main bars 30, and web openings (through holes) 40. In the following description, the +X-X direction in each drawing will be referred to as "width direction" as necessary. In particular, the +X direction will be referred to as "rightward direction" and the −X direction will be referred to as "leftward direction". The +Y-Y direction will be referred to as "depth direction" or "forward-rearward direction". In particular, the +Y direction will be referred to as "forward direction" and the −Y direction will be referred to as "rearward direction". The +Z-Z direction will be referred to as "height direction" or "upward-downward direction". In particular, the +Z direction will be referred to as "upward direction" and the −Z direction will be referred to as "downward direction". As for a vertical plane (YZ plane) passing through the axial center of the steel-framed concrete beam, the direction toward the plane along the width direction (+X-X) will be referred to as "inward direction" and the direction away from the plane along the width direction (+X-X) will be referred to as "outward direction".

(Configuration-Steel Form)

The steel form 10 is a steel form that has a groove portion (described later) for placing the binding beam concrete 20. This steel form 10 is provided in each binding beam 1 constituting a building and is disposed so as to cover the binding beam 1 from below. As illustrated in the drawing, the steel form 10 of Embodiment 1 is formed by a pair of (that is, two) Z-steels 11 being mutually joined in bottom plate portions 12 (described later) at a construction site. The invention is not limited thereto, and the steel form 10 may be integrally formed with a single member or may be formed by three or more members being combined. In a case where three or more members are combined as described above, for example, the integrally formed members (the bottom plate portion 12, a side plate portion 13, a flange portion 14, and a reinforcing portion 15 to be described later) that constitute the Z-steel 11 may be formed separately. Each of the pair of Z-steels 11 can be substantially similar in configuration to the other, and thus only one of the Z-steels 11 will be described below. In a case where the Z-steels 11 need to be distinguished from each other, the Z-steel 11 that is positioned on the right of the binding beam 1 (in the +X direction) will be referred to as "right Z-steel" and the Z-steel 11 that is positioned on the left of the binding beam 1 (in the −X direction) will be referred to as "left Z-steel". A specific method for forming the steel form 10 will be described later.

The Z-steel 11 is a frame member that constitutes the steel form 10. As illustrated in FIG. 1(*b*), the Z-steel 11 is a steel material that has a substantially Z-shaped axial cross section. The Z-steel 11 is provided with the bottom plate portion 12, the side plate portion 13, the flange portion 14, and the reinforcing portion 15.

The bottom plate portion 12 is a steel plate positioned on the bottom surface of the steel form 10. The bottom plate portion 12 has a joining surface 16 for mutually joining the respective bottom plate portions 12 of the pair of Z-steels 11. The pair of Z-steels 11 are joined to each other on the joining surface 16. For example, in Embodiment 1, a part of the bottom plate portion 12 of the right Z-steel is superposed on a part of the bottom plate portion 12 of the left Z-steel and each of the parts where the pair of Z-steels 11 are in contact with each other (the upper surface of the bottom plate portion 12 of the left Z-steel and the lower surface of the bottom plate portion 12 of the right Z-steel) is the joining surface 16. The joining on the joining surface 16 can be performed by any specific method. For example, in Embodiment 1, a plurality of bolt holes (not illustrated) are spaced apart along the longitudinal direction (+Y-Y direction) of the beam in the joining surfaces 16 of both Z-steels 11 and both Z-steels 11 are joined by bolt fastening by means of the bolt holes. Specific joining methods are not limited thereto. For example, welding-based joining and screw penetration-based joining may be performed instead.

The side plate portion 13 is a steel plate extending in the upward direction from the bottom plate portion 12. Specifically, the side plate portion 13 is a part that is folded back from the outer end of the bottom plate portion 12 and extends to the upper end of the beam and is positioned so as to cover the left and right sides of the binding beam 1. The length of the side plate portion 13 in the height direction (+Z-Z direction) is longer, by the thickness of the bottom plate portion 12, in the left Z-steel than in the right Z-steel. This is for the upper end positions of the side plate portions 13 of both Z-steels 11 (that is, the height positions of the flange portions 14) to coincide with each other when the pair of Z-steels 11 are overlapped.

In the following description, the part that is formed by the side plate portions 13 and the bottom plate portions 12 of a pair of the steel forms 10 and has a U-shaped axial cross section will be referred to as groove portion as necessary. Concrete can be placed in the groove portion by the steel form 10 forming the groove portion as described above. The lower and side parts of the binding beam 1 are covered with a steel plate by the groove portion, and thus it is possible to deter steam from escaping from the lower and side parts of the binding beam concrete 20 during a fire, it is possible to deter a temperature rise in the room below the binding beam 1, and it is possible to improve the fire resistance performance of the binding beam 1.

The flange portion 14 is a steel plate extending in the outward direction from the upper end of the side plate portion 13. Specifically, the flange portion 14 is a part that is folded back in the outward direction from the upper end of the side plate portion 13 and extends along a horizontal plane, and a deck plate 3 is placed and screwed on the flange portion 14. Although a case where this deck plate 3 is a known corrugated steel plate will be described, the invention is not limited thereto and a flat plate may be used as the deck plate 3. Although illustration is omitted, the binding beams 1 are arranged side by side at intervals along the longitudinal direction of a girder 2, one end portion of the deck plate 3 is placed in the flange portion 14 of one binding beam 1 as illustrated in FIG. 1(*b*), and the other end portion of the deck plate 3 is similarly placed in the flange portion 14 of the binding beam 1 that is adjacent to the one binding beam 1. By the flange portion 14 being provided as described above, the load of slab concrete 4 (described later) can be received by the flange portion 14 and is allowed to smoothly flow to the binding beam 1 and the proof stress of the binding beam 1 is improved.

The reinforcing portion 15 is a steel plate extending in the downward direction from the outer end of the flange portion 14. By the reinforcing portion 15 being provided as described above and thickness being given to the outer end of the flange portion 14, the local buckling of the outer end of the flange portion 14 that pertains to a case where the slab concrete 4 is placed and the flange portion 14 receives the load of the slab can be deterred. In addition, it is possible to reduce the overall thickness of the steel form 10 by locally reinforcing only a low-strength part by means of the reinforcing portion 15. The reinforcing portion 15 of Embodiment 1 extends in the downward direction from the outer end of the flange portion 14. The invention is not limited thereto and the reinforcing portion 15 may extend in, for example, the upward direction.

(Configuration-Binding Beam Concrete)

The binding beam concrete 20 is concrete placed in the groove portion that the pair of side plate portions 13 and the bottom plate portion 12 of the steel form 10 constitute. The binding beam concrete 20 is known concrete solidified after filling in the groove portion, and the plurality of web openings 40 are formed in the binding beam concrete 20 as described above. The slab concrete 4 for forming an upper floor slab is formed along a horizontal plane above the binding beam concrete 20. Girder concrete (reference numeral omitted) for forming the girder 2 is formed, so as to be orthogonal to the binding beam 1, at the front and rear ends of the binding beam concrete 20. Although the binding beam concrete 20, the slab concrete 4, and the girder concrete are given different names and reference numerals, the binding beam concrete 20, the slab concrete 4, and the girder concrete are simultaneously placed and formed in Embodiment 1. The binding beam concrete 20, the slab concrete 4, and the girder concrete will be simply referred to as "concrete" when no distinguishment among them is necessary.

(Configuration-Main Bar)

The main bars 30 are rebars extending along the axial center direction of the beam. Although two upper end bars and four lower end bars are illustrated as an example in Embodiment 1, the number and disposition of the main bars 30 are not limited thereto.

(Configuration-Web Opening)

The web opening 40 is a hole formed so as to penetrate the side plate portion 13 and the binding beam concrete 20. The web opening 40 is formed by, for example, the side plate portion 13 and the binding beam concrete 20 being drilled with a drill after the binding beam concrete 20 placed in the steel form 10 is solidified. By the web opening 40 being formed as described above, a duct or piping for air conditioning, electrical equipment, and so on can be passed through the web opening 40 (a case where a duct for air conditioning is passed through the web opening 40 will be described below). Accordingly, the duct can be extended from one of spaces sandwiching the beam 1 (such as the space to the right of the binding beam 1) to the other thereof (such as the space to the left of the binding beam 1) and the degree of freedom of duct disposition is improved.

The web opening 40 is formed in the web opening forming portion of the binding beam 1. The "web opening forming portion" is a part where the web opening 40 penetrating the side plate portion 13 and the binding beam concrete 20 can be formed. Specifically, the "web opening forming portion" is a part where no rebar (main bar 30 in Embodiment 1) is arranged (part where the drill does not interfere with the rebar when the web opening 40 is drilled with the drill). For example, in Embodiment 1, the "web opening forming portion" is a part above the lower main bar 30 (lower end bar) in the binding beam 1. The number of the web openings 40 is six and the web openings 40 are along the axial center direction of the beam in the illustration. The number of the web openings 40 is not limited to six.

(Configuration-Girder Joining Portion)

Figure 2:
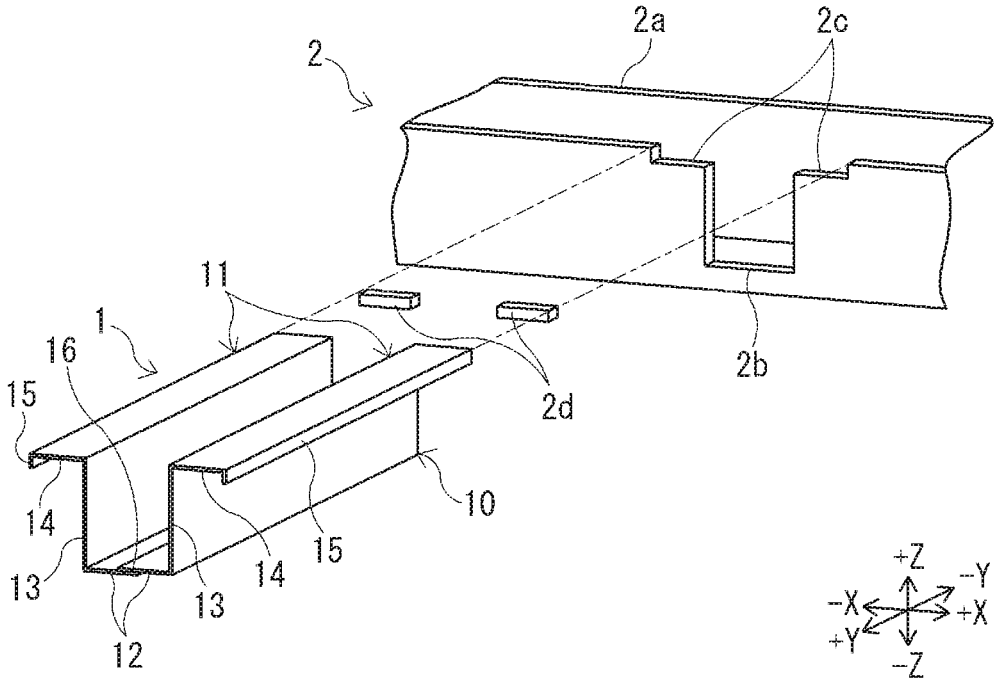
FIG. 2 is an exploded perspective view illustrating a temporary state during construction in the vicinity of the joining portion between the binding beam and a girder.

The joining portion between the binding beam 1 and the girder 2 according to Embodiment 1 will be described below. FIG. 2 is an exploded perspective view illustrating a temporary state during construction in the vicinity of the joining portion between the binding beam 1 and the girder 2. The concrete and the rebar that constitute the binding beam 1 and the girder 2 are not illustrated in FIG. 2 for convenience of illustration. As illustrated in FIG. 2, a notch (hereinafter, referred to as binding beam accommodating portion 2*b*) having a shape (hat shape) substantially corresponding to the axial cross-sectional shape of the binding beam 1 is formed in a side surface of a wooden form 2*a* of the girder 2 according to Embodiment 1. The binding beam 1 and the girder 2 can be formed at the same time by concrete being simultaneously placed in the wooden form 2*a* of the girder 2 and the steel form 10 with the steel form 10 of the binding beam 1 fitted in the binding beam accommodating portion 2*b*. As illustrated in the drawing, notches (hereinafter, referred to as flange accommodating portions 2*c*) having the same width as the flange portion 14 are formed on the left and right of the upper end of the binding beam accommodating portion 2*b*. The flange portion 14 can be housed in the flange accommodating portion 2*c*. In a case where the flange portion 14 is housed in the flange accommodating portion 2*c* as described above, a gap equivalent to the height of the reinforcing portion 15 is formed below the flange portion 14. A sealing material 2*d* (illustrated rectangular wood or the like) filling this gap is disposed for prevention of concrete leakage from the gap.

Temporary supports (not illustrated) may support the binding beam 1 until concrete placement. The positions and number of the temporary supports may be appropriately changed in accordance with the length and weight of the binding beam 1. For example, one temporary support may be provided in one axial end portion, one temporary support may be provided in the other axial end portion, and one temporary support may be provided in the axial middle portion. The steel form 10 is higher in proof stress than the wooden form 2*a*, and thus the temporary supports may be omitted if the temporary supports are unnecessary in view of the length and weight of the binding beam 1.

(Method for Designing Steel Form)

Next, an example of a method for designing the steel form 10 according to Embodiment 1 will be described. In the present embodiment, the allowable bending moment or the allowable shear force of the binding beam 1 is calculated by the following Equation (1).

$$F_a = F_{RC} + \beta \cdot F_S \quad \text{(Equation 1)}$$

$F_a$: allowable bending moment or allowable shear force of binding beam 1

$F_{RC}$: allowable bending moment or allowable shear force of binding beam concrete 20 (hereinafter, referred to as reinforced concrete ("RC") as necessary)

$\beta$: burden factor of allowable bending moment or allowable shear force of steel form 10, which is 0.5 or less $F_S$: allowable bending moment or allowable shear force of steel form 10

(Method for Designing Steel Form-Method for Designing Allowable Bending Moment)

Figure 3:
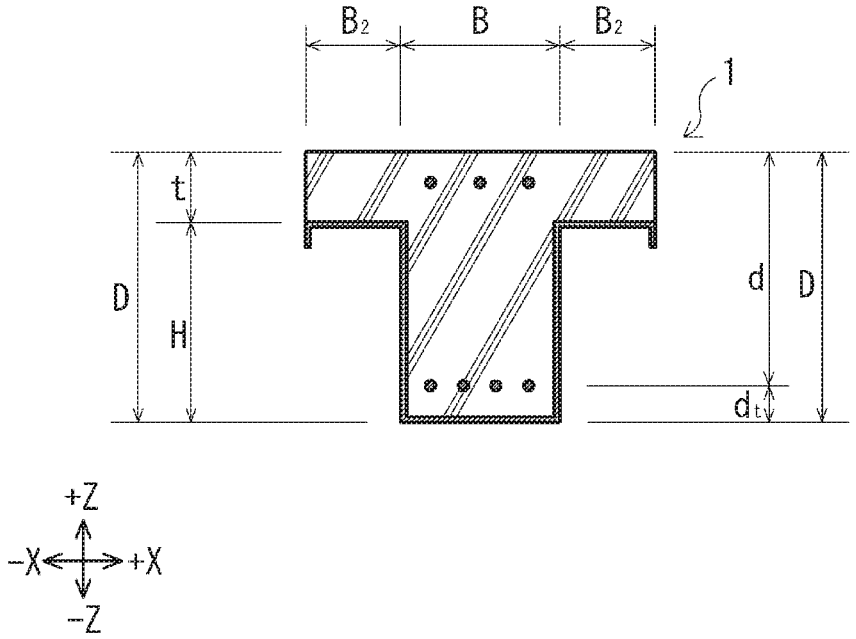
FIG. 3 is a view illustrating the relationship between a cross section of the binding beam and calculation parameters.

This design method will be divided into an allowable bending moment design method and an allowable shear force design method and described in further detail below. The allowable bending moment design method will be described first. The allowable bending moment is designed after division into a long-term allowable bending moment and a short-term allowable bending moment. The long-term allowable bending moment is calculated by the following Equation (2). The short-term allowable bending moment is calculated by the following Equation (3). FIG. 3 is a view illustrating the relationship between the cross section of the binding beam 1 and calculation parameters.

$${}_LM_a = {}_LM_{RC} + {}_L\beta_M \cdot {}_LM_S \quad \text{(Equation 2)}$$

$${}_SM_a = {}_SM_{RC} + {}_S\beta_M \cdot {}_SM_S \quad \text{(Equation 3)}$$

${}_LM_{RC}$: long-term allowable bending moment of RC cross section part (which may be $a_t \cdot {}_Lf_t \cdot j$ in case where tensile rebar ratio of RC cross section is balanced rebar ratio or less)

${}_SM_{RC}$: short-term allowable bending moment of RC cross section part (which may be $a_t \cdot {}_Sf_t \cdot j$ in case where tensile rebar ratio of RC cross section is balanced rebar ratio or less)

$a_t$: tensile rebar cross-sectional area ${}_Lf_t$: long-term allowable tensile stress of tensile rebar ${}_Sf_t$: short-term allowable tensile stress of tensile rebar j: stress center distance (j=(7/8)·d)

d: effective depth of cross section (distance from upper surface of binding beam 1 to concrete bar arrangement)

${}_L\beta_M$: long-term steel frame bending burden effective factor of 0.5 or less, 0.1 here ${}_S\beta_M$: short-term steel frame bending burden effective factor of 0.5 or less, 0.4 here ${}_LM_S$: long-term allowable bending moment of S cross section part (${}_LM_S = {}_S\sigma_t * Z_S$)

${}_SM_S$: short-term allowable bending moment of S cross section part (${}_SM_S = {}_S\sigma_t \cdot Z_S$)

${}_L\sigma_t$: long-term allowable tensile stress of steel form 10

${}_S\sigma_t$: short-term allowable tensile stress of steel form 10

$Z_S$: section modulus of steel form 10

An ultimate bending strength Mu is calculated by the following Equation (4).

$$M_u = M_{uRC} + M_{uS} \quad \text{(Equation 4)}$$

$M_{uRC}$: ultimate bending strength of RC cross section part ($M_{uRC}=0.9\cdot a_t\cdot 1.1\cdot {}_Sf_t\cdot d$)

$a_t$: tensile rebar cross-sectional area ${}_Sf_t$: short-term allowable tensile stress of tensile rebar d: effective depth of cross section $M_{uS}$: ultimate bending strength of S cross section part ($M_{uS}=1.1\cdot {}_S\sigma_t\cdot Z_p$)

$s\sigma_t$: short-term allowable tensile stress of steel form 10

$Z_p$: plastic section modulus of steel form 10

The long-term allowable bending moment is an allowable bending moment over a relatively long time (such as several years to several decades). The short-term allowable bending moment is an allowable bending moment over a relatively short time (such as several hours to several days). The allowable bending moment is calculated after the division into the two periods as described above so that an allowable bending moment suitable for each load bearing ratio is designed in view of the fact that the load bearing ratio of the RC and the steel form 10 in the binding beam 1 can vary as the situation of loading on the binding beam 1 can vary with the lengths of the periods. In other words, it is assumed that the loading on the binding beam 1 is relatively small in a relatively long time, and thus it is assumed that the RC of the binding beam 1 is maintained without breaking (see the lower left cross section in FIG. 4 (described later)) and the load bearing ratio of the RC increases. In a relatively short time, it is assumed that the loading on the binding beam 1 is relatively large (for example, the loading becomes relatively large by a forklift that carries a heavy object passing through the binding beam 1), and thus it is assumed that the load bearing ratio of the RC decreases as a result of cracking at the lower end of the RC of the binding beam 1 (see the lower left cross section in FIG. 5 (described later), as indicated by a diagonal line in this cross section, it is assumed that only approximately the upper two-thirds of the slab part of the RC remains without cracking and bears the load). In this regard, in the present embodiment, the load bearing ratio of the RC and the steel form 10 in the binding beam 1 is expressed in Equations 2 and 3 as a steel frame bending burden effective factor $\beta_M$, and then this steel frame bending burden effective factor $\beta_M$ is given different values in the long-term and short-term cases and the allowable bending moment suitable for each load bearing ratio is designed as a result. By adopting the design method, it is possible to calculate a complex allowable bending moment taking long-term and short-term loading situations into account and it is possible to optimize the design of the binding beam 1.

The steel frame bending burden effective factor $\beta_M$ can be calculated from a bending rigidity ratio $\zeta_M(=E_SI_S/E_CI_C)$ of the RC and a bending rigidity $E_SI_S$ of the steel form 10. The bending rigidity ratio $\zeta_M$ can vary with the plate thickness of the steel form 10 and the thickness of the slab concrete 4 attached to the binding beam 1 (hereinafter, referred to as "slab" as necessary), and thus an application restriction range is set for each of the plate thickness of the steel form 10 and the thickness of the slab, the bending rigidity ratio $\zeta_M$ is calculated on the premise of the application restriction range, and the steel frame burden effective factor $\beta_M$ is determined from the calculated bending rigidity ratio $\zeta_M$. Specifically, the plate thickness of the steel form 10 has an application restriction range of 3.2 mm or more. The load bearing ratio of the steel form 10 increases as the plate thickness of the steel form 10 increases, and thus a lower limit value of "3.2 mm" and application restriction range setting "at or above" the lower limit value allow the steel frame burden effective factor $\beta_M$ to remain above it insofar as the plate thickness of the steel form 10 is determined in the application restriction range. The thickness of the slab has an application restriction range of 200 mm or less. The ratio of load bearing by the slab increases as the thickness of the slab increases, and then the load bearing ratio of the steel form 10 decreases. Accordingly, an upper limit value of "200 mm" and application restriction range setting "at or below" the upper limit value allow the steel frame burden effective factor $\beta_M$ to remain above it insofar as the thickness of the slab is determined in the application restriction range.

Figure 4:
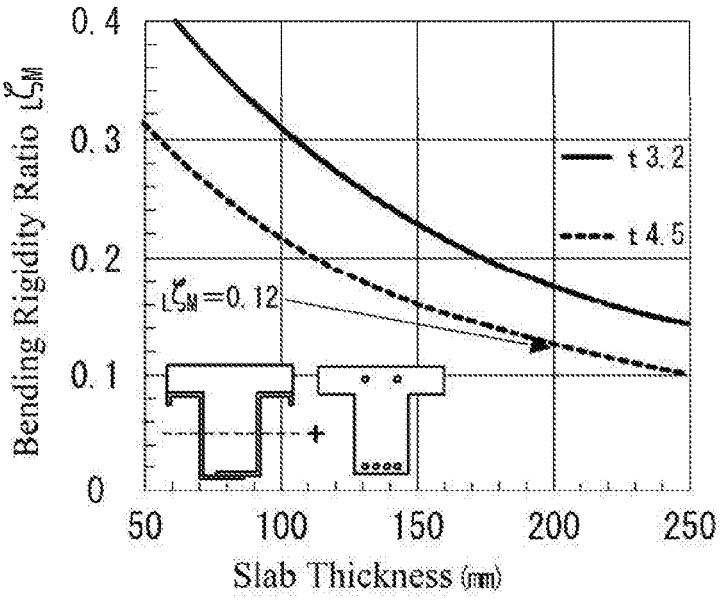
FIG. 4 is a graph showing the relationship between a slab thickness and a long-term bending rigidity ratio.
Figure 5:
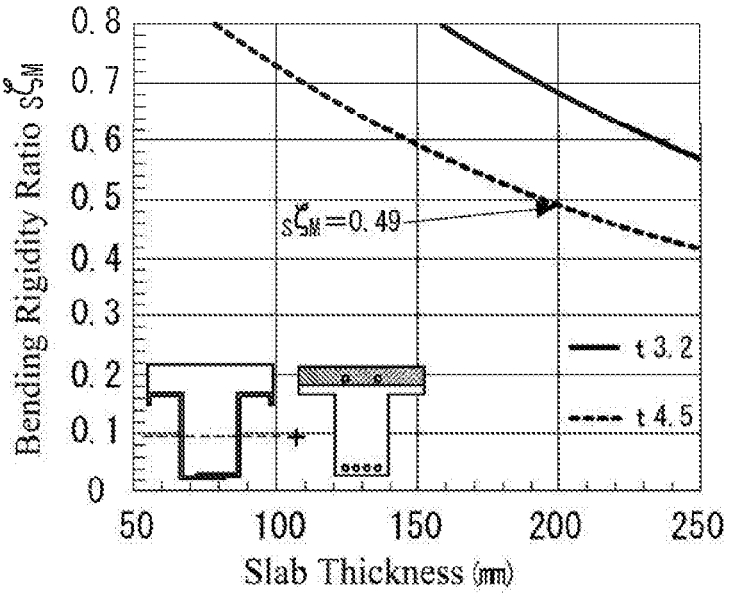
FIG. 5 is a graph showing the relationship between the slab thickness and a short-term bending rigidity ratio.

FIG. 4 is a graph showing the relationship between the thickness of the slab and a long-term bending rigidity ratio ${}_L\zeta_M$, and FIG. 5 is a graph showing the relationship between the thickness of the slab and a short-term bending rigidity ratio ${}_S\zeta_M$. In each graph, the horizontal axis represents the thickness of the slab, the vertical axis represents the bending rigidity ratio $\zeta_M$ (long-term bending rigidity ratio ${}_L\zeta_M$ or short-term bending rigidity ratio ${}_S\zeta_M$), the solid line indicates a load of 3.2 tons, and the dotted line indicates a load of 4.5 tons. It is assumed that the cross-sectional shape of the binding beam 1 is a standard cross section (6.5 m in total length, 300 mm in total width, and 550 mm in total height). As shown in FIG. 4, in the long term, the long-term bending rigidity ratio ${}_L\zeta_M$ is approximately 0.12 at 200 mm, which is the upper limit value of the application restriction range of the slab thickness, and thus the long-term bending rigidity ratio ${}_L\zeta_M$ was set to 0.1 in view of safety. As shown in FIG. 5, in the short term, the short-term bending rigidity ratio ${}_S\zeta_M$ is approximately 0.49 at 200 mm, which is the upper limit value of the application restriction range of the slab thickness, and thus the short-term bending rigidity ratio ${}_S\zeta_M$ was set to 0.4 in view of safety. Then, calculation can be performed based on the long-term bending rigidity ratio ${}_L\zeta_M$ of 0.1 and the short-term bending rigidity ratio ${}_S\zeta_M$ of 0.4 and in accordance with proof stress formula $M_a=(1+{}_L\zeta_M)M_{RC}$ and steel frame bending burden effective factor $\beta_M=\zeta_M(M_{RC}/M_S)$. Here, $M_{RC}/M_S$ is the allowable proof stress ratio between the RC cross section and the steel form 10 and $M_{RC}/M_S$ is 1.35 in a case where the bar arrangement of the RC cross section is 4-HD13 (four deformed rebars (steel deformed bars) having a yield point of 345 N/mm2 or more) and the plate thickness of the steel form 10 is 3.2 mm in the cross sections in FIGS. 4 and 5. Here, the steel frame bending burden effective factor $\beta_M$ was calculated using $M_{RC}/M_S=1.0$ as a value of safety side. As described above, in the present embodiment, a simplified method (β method) is used in which the restriction of the application restriction range is applied to the plate thickness of the steel form 10 and the thickness of the slab. Alternatively, a detail method (method) may be adopted in which the bending rigidity ratio $\zeta_M$ is set in accordance with each cross-sectional shape (plate thickness of the steel form 10, slab thickness, and bar arrangement) and the steel frame bending burden effective factor $\beta_M$ is calculated by using proof stress formula $M_a=(1+{}_L\zeta_M)M_{RC}$. Here, the design formula is determined on the safety side so that the design formula does not become complicated (low iron burden rate being set in terms of design). As confirmed by the inventor's experiment, the cross section part of the steel form 10 is restrained by the RC cross section part and the steel form 10 undergoes no lateral buckling as a thin plate, and thus a tensile stress $f_t$ is adopted as an allowable stress $f_b$ of the steel material of the steel form 10.

(Method for Designing Steel Form-Method for Designing Allowable Shear Force)

Next, the allowable shear force design method will be described. The allowable shear force is designed after division into a long-term allowable shear force and a short-term allowable shear force similarly to the above idea related to the allowable bending moment. The long-term allowable shear force is calculated by the following Equation (5) and the short-term allowable shear force is calculated by the following Equation (6). The relationship between the cross section of the binding beam 1 and calculation parameters is as illustrated in FIG. 3.

$$_{L}Q_a=\alpha\cdot A_{C}\cdot {}_{L}f_S+\beta_{Q}\cdot {}_{S}A_{W}\cdot {}_{L}\sigma_S \quad \text{(Equation 5)}$$

$$_{S}Q_a=\alpha\cdot A_{C}\cdot {}_{S}f_S+\beta_{Q}\cdot {}_{S}A_{W}\cdot {}_{S}\sigma_s \quad \text{(Equation 6)}$$

$\alpha$: additional factor by shear span ratio ($M/Q_d$)

$A_C$: shear effective cross-sectional area of RC portion ($A_C=B\cdot j+2\cdot B_2\cdot t$)

$_{L}f_S$: long-term allowable shear stress of concrete $_{S}f_S$: short-term allowable shear stress of concrete $\beta_Q$: steel frame shear burden effective factor of 0.5 or less, 0.2 here $_{S}A_W$: shear cross-sectional area of steel form 10 ($_{S}A_W=2\cdot t_S\cdot(H-2\cdot r)$)

$t_S$: thickness of steel plate r: curvature radius of corner of Z-steel plate 11

$_{L}\sigma_S$: long-term allowable shear stress of steel material of Z-steel plate 11 ($_{L}\sigma_S$=square root of $_{L}\sigma t/3$)

$_{S}\sigma_S$: short-term allowable shear stress of steel material of Z-steel plate 11 ($_{S}\sigma_S$=square root of $_{S}\sigma t/3$)

Figure 6:
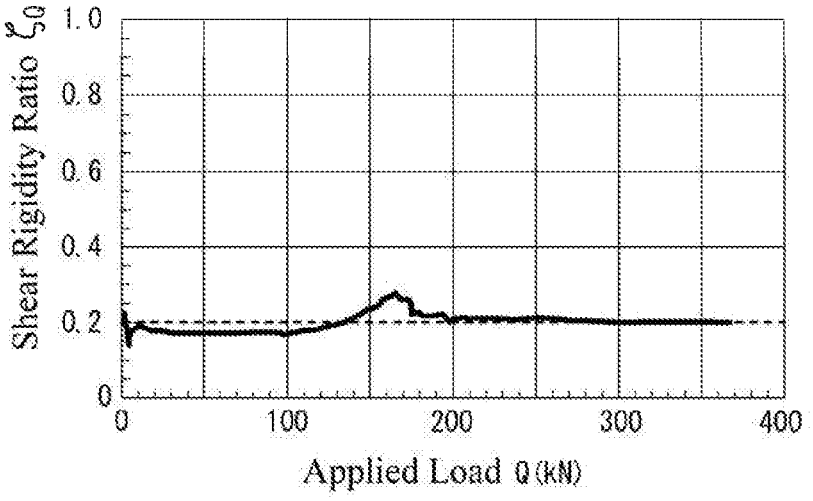
FIG. 6 is a graph showing the relationship between the load that is applied to the binding beam and the shear rigidity ratio of a steel form, which pertains to a case where no web opening is present.
Figure 7:
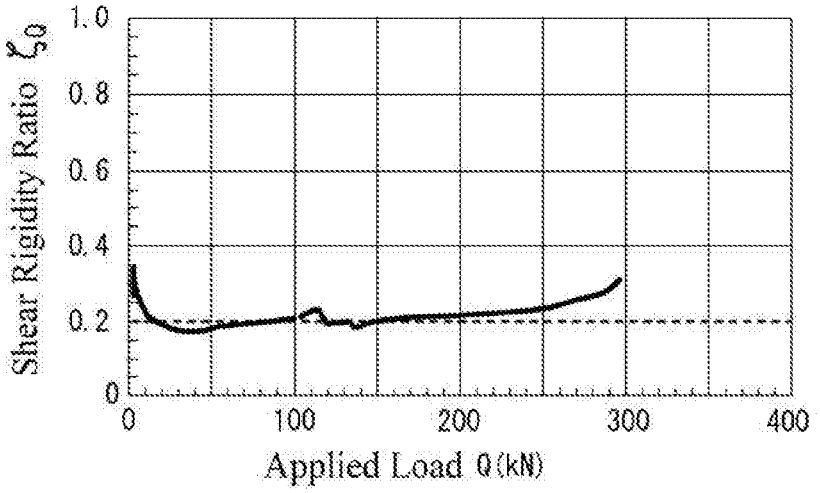
FIG. 7 is a graph showing the relationship between the load that is applied to the binding beam and the shear rigidity ratio of the steel form, which pertains to a case where a web opening is present.

The shear effective cross-sectional area $A_C$ of the RC portion used in the shear force calculation is the same cross section as the binding beam 1 used in the experiment as illustrated in FIG. 3 and the cross-sectional area of the slab on the flange portion of the steel form 10 may also be included. The steel frame shear burden effective factor $\beta_Q$ in the shear force calculation formula can be obtained from a shear rigidity ratio $\zeta_Q$ of the steel form 10 indicated by the result of the inventor's experiment. FIG. 6 is a graph showing the relationship between the load that is applied to the binding beam 1 and the shear rigidity ratio $\zeta_Q$ of the steel form 10, which pertains to a case where the web opening (opening) 40 is absent. FIG. 7 is a graph showing the relationship between the load that is applied to the binding beam 1 and the shear rigidity ratio $\zeta_Q$ of the steel form 10, which pertains to a case where the web opening (opening) 40 is present. In each graph, the horizontal axis represents the applied load and the vertical axis represents the shear rigidity ratio $\zeta_Q$. As is apparent from FIGS. 6 and 7, the shear rigidity ratio $\zeta_Q$ of the steel form 10 is substantially constant at approximately 0.2 regardless of the presence or absence of the web opening 40 and the magnitude of the applied load. Accordingly, in the present embodiment, the steel frame shear burden effective factor $\beta_Q$ was obtained with shear rigidity ratio $\zeta_Q$ set to 0.2. The steel frame shear burden effective factor $\beta_Q$ is calculated from $\beta_Q=\zeta_Q(Q_{RC}/Q_S)$ by detail method ($\zeta$ method)-based proof stress formula $Q_L=(1+{}_{L}\zeta_Q)_{L}Q_{RC}$. Here, $Q_{RC}/Q_S$ is the ratio between the shear capacity of the steel form 10 and the RC cross section. $Q_{RC}/Q_S$ is 1.04 in a case where the cross-sectional shape of the binding beam 1 is a standard cross section (6.5 m in total length, 300 mm in total width, and 550 mm in total height) and the thickness of the steel form 10 is 3.2 mm. Here, the steel frame shear burden effective factor $\beta_Q$ of 0.2 was calculated using $Q_{RC}/Q_S=1.0$ as a value of safety side. Also in this shear design formula, $\zeta_Q$ is constant at 0.2 as the detail method ($\zeta$ method) and obtainment is also possible from equation $Q_a=(1+\zeta_Q)Q_{RC}$ obtained from the allowable proof stress of the RC cross section. As with the bending design formula, however, the steel frame burden effective factor was clarified in the design formula.

As described above, the long-term steel frame bending burden effective factor $_{L}\beta_M$ is 0.1 and the short-term steel frame bending burden effective factor $_{S}\beta_M$ is 0.4 in the design of the allowable bending moment. In the design of the allowable shear force, the steel frame shear burden effective factor $\beta_Q$ is 0.2. Although the burden factor $\beta$ of the steel form 10 may be another value, the upper limit of the load bearing ratio of the steel form 10 is set to 50% and the burden factor $\beta$ of the steel form 10 is set to 0.5 or less for safety enhancement. The lower limit of the load bearing ratio of the steel form 10 can be at least 10% in view of the graphs in FIGS. 6 and 7 and the burden factor $\beta$ of the steel form 10 can be set to 0.1 or more. However, the steel form 10 may be used only as a form of the binding beam concrete 20 and the steel form 10 may be allowed to bear no load. In this case, the burden factor $\beta$ of the steel form 10 may be 0. By adopting the design method, it is possible to calculate a complex allowable bending moment and a complex allowable shear force taking the respective bearing ratios of the steel form 10 and the binding beam concrete 20 into account and it is possible to optimize the design of the binding beam 1.

(Steel Form Forming Method)

Next, an example of the method for forming the steel form 10 according to Embodiment 1 will be described. First, the Z-steel 11 is manufactured at a factory. The Z-steel 11 can be manufactured by any specific method. For example, the Z-steel 11 can be formed by bending of one flat thin steel plate. Subsequently, the manufactured Z-steel 11 is transported to a construction site. At this time, a plurality of the Z-steels 11 can be transported in an overlapping manner, and thus it is possible to transport more Z-steels 11 at one time than in the case of transporting the pair of mutually joined Z-steels 11. Transport efficiency enhancement can be achieved as a result.

The sealing material (small piece) 2*d* described with reference to FIG. 2 may be attached to the lower part of the flange portion 14 by any method such as adhesion before the transport. In this case, the strength of the flange portion 14 or the reinforcing portion 15 can be enhanced by the sealing material 2*d* and deformation of the flange portion 14 or the reinforcing portion 15 attributable to a load or an impact during the transport can be prevented. For a similar purpose, a reinforcing material (not illustrated) similar in shape to the sealing material 2*d* may be provided at a predetermined interval below the flange portion 14 or a long reinforcing material (not illustrated) resulting from extension of the sealing material 2*d* in the Y direction in FIG. 2 may be provided below the flange portion 14. Such reinforcing materials may be removed after the transport or may be permanently fixed without removal. The strength of the flange portion 14 or the reinforcing portion 15 can be reduced to the same extent in a case where the strength of the flange portion 14 or the reinforcing portion 15 can be improved by such a reinforcing material being provided, and thus the flange portion 14 and the reinforcing portion 15 may be reduced in thickness or the dimension at which the reinforcing portion 15 extends from the flange portion 14 may be shortened.

Next, the pair of Z-steels 11 transported to the construction site are joined together and the steel form 10 is formed. Specifically, as illustrated in FIG. 1(*b*), the bottom plate portions 12 of the right Z-steel and the left Z-steel are overlapped and, in that state, a bolt may be inserted through and fastened in each of bolt holes (not illustrated) formed at an appropriate interval at the overlapping part of both bottom plate portions 12. When both Z-steels are joined in this manner, it is preferable to attach a member for maintaining a constant interval between the respective side plate portions 13 of the Z-steels 11. For example, a batten positioned in the groove portion and fixing the interval by propping the side plate portions 13 or a U-shaped veneer board fitted to the outer edge shape of the groove portion may be temporarily installed and removed after both Z-steels 11 are joined to each other.

(Binding Beam Construction Method)

Figure 8:
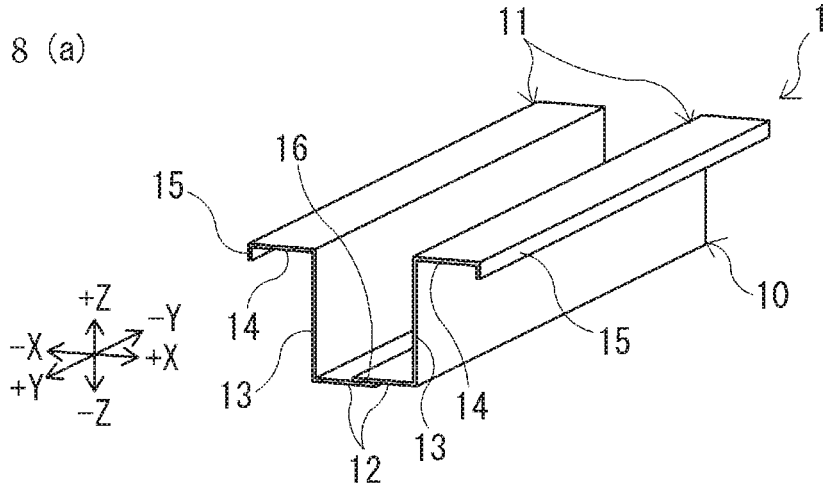
FIGS. 8(*a*)-8(*c*) are a set of cross-sectional perspective views corresponding to the A-A arrow cross section in FIG. 1(*a*), in which FIG. 8(*a*) illustrates the binding beam at the completion of a steel form installation step, FIG. 8(*b*) illustrates the binding beam at the completion of main bar arrangement, deck plate installation, and placement steps, and FIG. 8(*c*) illustrates the binding beam at the completion of a penetration step.
Figure 8:
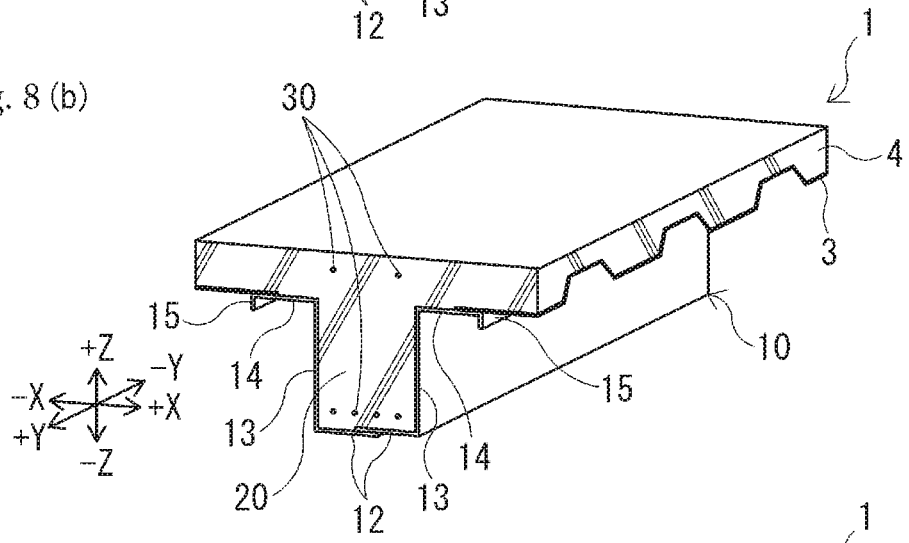
Figure 8:
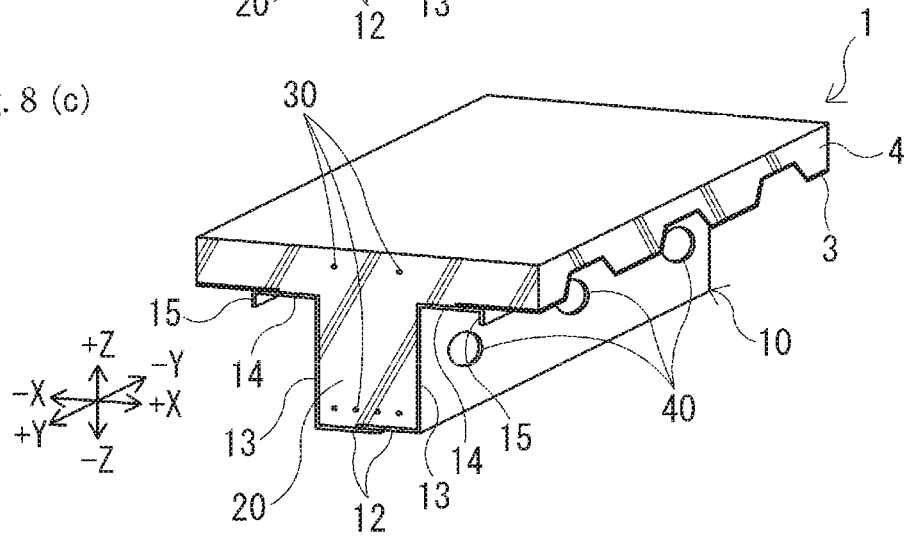

A method for constructing the binding beam 1 according to Embodiment 1 will be described below. FIG. 8 is a set of cross-sectional perspective views corresponding to the A-A arrow cross section in FIG. 1(*a*). FIG. 8(*a*) illustrates the binding beam 1 at the completion of a steel form installation step. FIG. 8(*b*) illustrates the binding beam 1 at the completion of main bar arrangement, deck plate installation, and placement steps. FIG. 8(*c*) illustrates the binding beam 1 at the completion of a penetration step.

First, the steel form installation step is performed as illustrated in FIG. 8(*a*). In the steel form installation step, the steel form 10 formed by the above-described forming method is lifted by a heavy machine or the like and installed at a beam construction position. In Embodiment 1, the installation is performed such that an end portion of the steel form 10 is connected to the wooden form 2*a* of the girder 2 as illustrated in FIG. 2. For convenience of illustration, the steel form 10 of the binding beam 1 in FIG. 2 is illustrated as being tightly fit in the notch (binding beam accommodating portion 2*b*) of the wooden form 2*a* of the girder 2. However, the invention is not limited thereto. The binding beam accommodating portion 2*b* may be enlarged in the width direction so that insertion of the steel form 10 into the binding beam accommodating portion 2*b* is facilitated and the space between the steel form 10 and the binding beam accommodating portion 2*b* may be filled with wood or the like after the insertion of the steel form 10. After the steel form 10 is installed as described above, the steel form 10 is supported by means of a temporary support so as to be capable of enduring the subsequent concrete placement.

Subsequently, the main bar arrangement, deck plate installation, and placement steps are performed as illustrated in FIG. 8(*b*).

The main bars 30 are arranged in the steel form 10 in the main bar arrangement step. Specifically, the main bars 30 are assembled, lifted by means of a heavy machine or the like, and dropped into and disposed in the groove portion. Likewise, the main bars 30 (not illustrated) of the girder 2 are dropped into and disposed in the wooden form 2*a* of the girder 2. Then, the main bars 30 of the binding beam 1 are bent in, for example, end portions and fixed to the main bars 30 of the girder 2.

The deck plates 3 are installed on the flange portions 14 of the steel form 10 in the deck plate installation step. In the deck plate installation step, the plurality of deck plates 3 are placed on the flange portions 14 so as to bridge one binding beam 1 and another adjacent binding beam 1 and fixed to the flange portions 14 by bolt fastening or the like.

In the placement step, the binding beam concrete 20 is placed in the groove portion that is configured by the pair of side plate portions 13 and the bottom plate portion 12 of the steel form 10 installed in the steel form installation step. Specifically, in this placement step, concrete is poured into the groove portion of the steel form 10 while a vibrator is used for air bubble mixing prevention. As described above, in Embodiment 1, concrete is simultaneously placed in the wooden form 2*a* of the girder 2 and on the deck plate 3, and then the binding beam 1, the girder 2, and the slab are integrally formed.

Subsequently, the penetration step is performed as illustrated in FIG. 8(*c*). Formed in the penetration step is the web opening 40 penetrating the steel form 10 installed in the steel form installation step and the binding beam concrete 20 placed in the placement step. Specifically, in this penetration step, the side plate portion 13 of one Z-steel 11, the binding beam concrete 20, and the side plate portion 13 of the other Z-steel 11 are sequentially penetrated by means of an excavator (such as a known drill) after the concrete placed in the placement step realizes a predetermined strength, and the web opening 40 is formed as a result. Then, the plurality of web openings 40 are formed by similar work being performed in a plurality of places of the beam. The number of the web openings 40 may correspond to the number of ducts to be disposed.

The size and the position of disposition of the web opening 40 can be determined similarly to general RC. For example, it is preferable that the maximum diameter of the web opening 40 is one-third or less of the height of the binding beam 1 (dimension D in FIG. 3), the position of disposition is other than the end portion of the binding beam 1 (range to one-tenth of the total length of the binding beam 1 and range equivalent to twice the diameter of the web opening 40 from the end portion of the binding beam 1), and the interval between the plurality of web openings 40 is at least 1.5 times the total value of the respective diameters of the web openings 40. The size and the position of disposition of the web opening 40 are not limited to the example and can be determined in any manner insofar as the required strength of the binding beam 1 can be ensured.

Lastly, a duct is passed through the web opening 40 formed in the penetration step. The passage of the duct (not illustrated) is performed by a known method and will not be described in detail. This is the end of the description of the binding beam construction method according to Embodiment 1.

Effects of Embodiment 1

As described above, in the binding beam 1 of Embodiment 1, the binding beam concrete 20 has an outer shell covered by the steel form 10, and thus it is possible to suppress a decline in proof stress during the formation of the web opening 40 in the side surface of the binding beam 1 and it is possible to reduce the labor and cost entailed by separate reinforcing member attachment for forming the web opening 40.

In addition, it is possible to calculate a complex allowable bending moment and a complex allowable shear force taking the respective bearing ratios of the steel form 10 and the binding beam concrete 20 into account and it is possible to optimize the design of the binding beam 1.

Since the outer shell of the binding beam concrete 20 is covered by the steel form 10, the part where the web opening 40 can be formed is not limited to the part of reinforcing member attachment unlike in the related art. As a result, the degree of freedom of the size and disposition of the web opening 40 can be enhanced.

Since the flange portion 14 is provided, the load of the slab supported by the binding beam 1 can be received by the flange portion 14 and is allowed to smoothly flow to the binding beam 1 and the proof stress of the binding beam 1 is improved.

Since the reinforcing portion 15 is provided at the outer end of the flange portion 14, buckling of the flange portion 14 at a time when the binding beam concrete 20 is placed on the groove portion or the flange portion 14 of the steel form 10 can be suppressed by the reinforcing portion 15 and the proof stress of the binding beam 1 is improved.

Embodiment 2

Next, a binding beam according to Embodiment 2 will be described. Schematically, Embodiment 2 relates to a construction method in which a cylindrical form is pre-installed in the web opening forming portion and a web opening is formed in the place of cylindrical form installation by post-concrete placement cylindrical form removal. The configuration of the binding beam according to Embodiment 2 after completion is substantially the same as the configuration of the binding beam according to Embodiment 1, and regarding the configuration substantially the same as the configuration of Embodiment 1, the same reference numerals and/or names as those used in Embodiment 1 are attached thereto as necessary, and a description thereof will be omitted. The following description covers a steel form forming method and a binding beam construction method in relation to the binding beam according to Embodiment 2. Description will be appropriately omitted as to procedures similar to those of Embodiment 1.

(Steel Form Forming Method)

First, an example of the method for forming the steel form 10 according to Embodiment 2 will be described. First, the Z-steel 11 is manufactured at a factory. At this time, a circular hole 51 is formed in advance at a position corresponding to the web opening forming portion in the Z-steel 11. In other words, in Embodiment 2, the circular hole 51 is provided at each of the positions (six places in total in the drawing) in the side plate portion 13 of the Z-steel 11 that corresponds to the web opening 40 illustrated in FIG. 1(*a*) by means of any tool such as a cutting machine. Subsequently, the Z-steel 11 having the circular holes 51 as described above is transported to a construction site, and then a pair of the Z-steels 11 transported to the construction site are bolt-joined together. The steel form 10 is formed as a result. The specific method for the joining is similar to that of Embodiment 1 and will not be described in detail.

(Binding Beam Construction Method)

Figure 9:
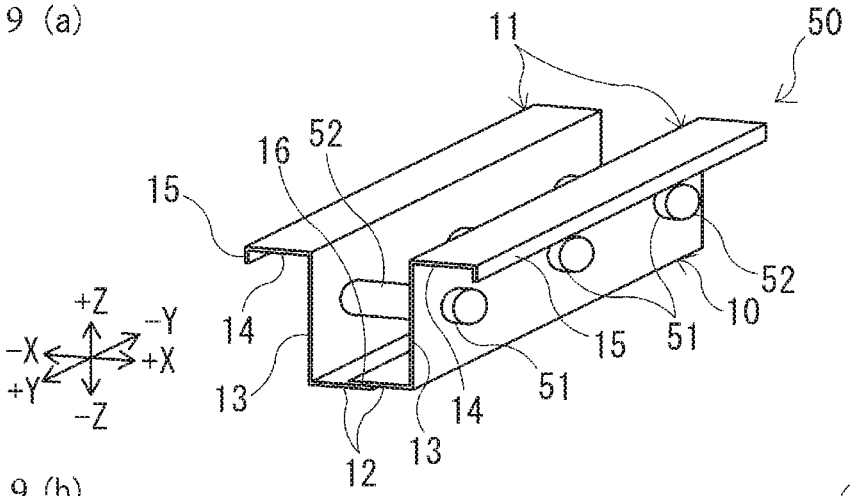
FIGS. 9(*a*)-9(*c*) are a set of cross-sectional perspective views corresponding to the A-A arrow cross section in FIG. 1(*a*), in which FIG. 9(*a*) illustrates the binding beam at the completion of steel form installation and cylindrical form installation steps, FIG. 9(*b*) illustrates the binding beam at the completion of main bar arrangement, deck plate installation, and placement steps, and FIG. 9(*c*) illustrates the binding beam at the completion of a penetration step.
Figure 9:
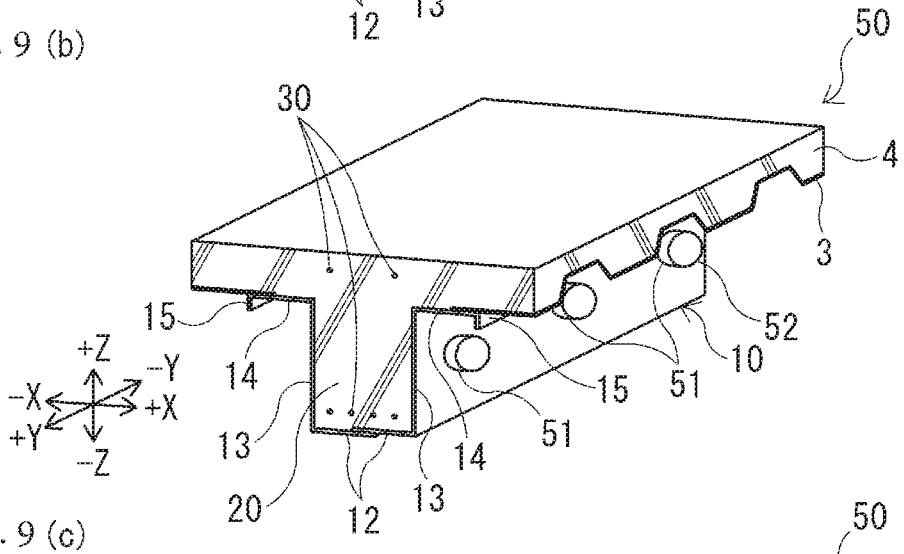
Figure 9:
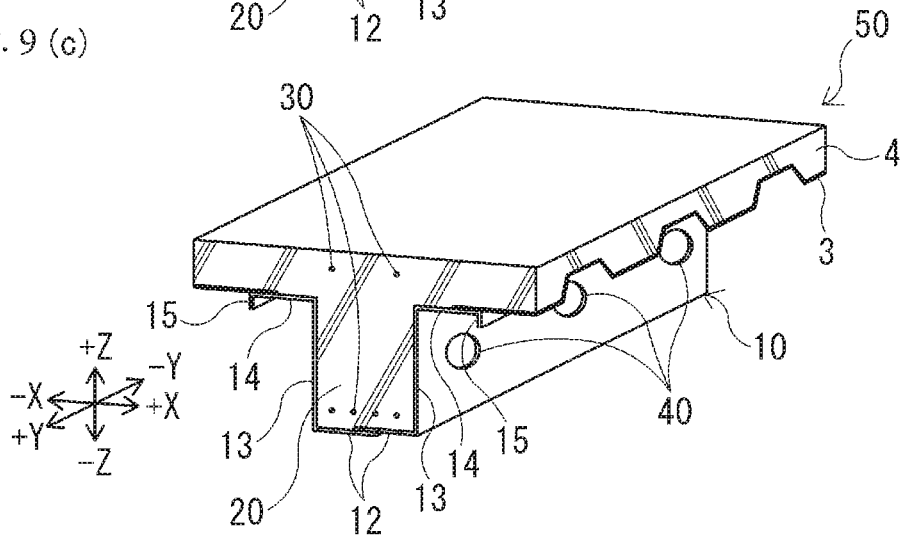

The method for constructing a binding beam 50 according to Embodiment 2 will be described below FIG. 9 is a set of cross-sectional perspective views corresponding to the A-A arrow cross section in FIG. 1(*a*). FIG. 9(*a*) illustrates the binding beam 50 at the completion of steel form installation and cylindrical form installation steps. FIG. 9(*b*) illustrates the binding beam 50 at the completion of main bar arrangement, deck plate installation, and placement steps. FIG. 9(*c*) illustrates the binding beam 50 at the completion of a penetration step.

First, the steel form installation and cylindrical form installation steps are performed as illustrated in FIG. 9(*a*). The steel form installation step is similar to that of Embodiment 1 and will not be described in detail.

In the cylindrical form installation step, a cylindrical form 52 is inserted into the circular hole 51 formed in the steel form 10. The axial length of the cylindrical form 52 (length in the +X-X direction) exceeds the width of the groove portion of the steel form 10 (length in the +X-X direction), and thus both end portions of the cylindrical form 52 protrude to the outside from the circular hole 51 as illustrated in the drawing. Although the cylindrical form 52 may be hollow or solid and any material can be used for the cylindrical form 52 insofar as the load of concrete can be withstood, the case of a solid wooden form will be described below. After the cylindrical form 52 is installed as described above, the gap between the outer periphery of the cylindrical form 52 and the inner periphery of the circular hole 51 is filled with a sealing material (not illustrated) such as putty. Concrete leakage is deterred as a result.

Subsequently, the main bar arrangement, deck plate installation, and placement steps are performed as illustrated in FIG. 9(*b*). The main bar arrangement, deck plate installation, and placement steps can be carried out similarly to the main bar arrangement, deck plate installation, and placement steps according to Embodiment 1, respectively. Accordingly, detailed descriptions of the steps will be omitted.

Subsequently, the penetration step is performed as illustrated in FIG. 9(*c*). Formed in the penetration step is the web opening 40 penetrating the steel form 10 installed in the steel form installation step and the concrete placed in the placement step. Specifically, in this penetration step, the cylindrical form 52 installed in the cylindrical form installation step is removed to the outside of the binding beam 50 after the concrete placed in the placement step realizes a predetermined strength. As a result, the web opening 40 is formed at the position where the cylindrical form 52 was present (web opening forming portion). In a case where the cylindrical form 52 is given a hollow shape, a duct can be inserted through the hollow part of the steel form 10, and thus the cylindrical form 52 may not be removed. In addition, a part of the duct may be used as the cylindrical form 52.

Lastly, a duct is passed through the web opening 40 formed in the penetration step. The passage of the duct (not illustrated) is performed by a known method and will not be described in detail. This is the end of the description of the method for constructing the binding beam 50 according to Embodiment 2.

Effects of Embodiment 2

As described above, with the binding beam 50 of Embodiment 2, it is possible to form the web opening 40 simply by removing the cylindrical form 52. Accordingly, it is possible to simplify the work for forming the web opening 40 at a construction site.

[III] MODIFICATION EXAMPLES REGARDING EMBODIMENTS

The embodiments according to the invention have been described. However, the specific configurations and means of the invention can be modified and improved in any manner within the scope of the technical idea of each invention described in the claims. Such modification examples will be described below.

Regarding Problems to be Solved and Effects of Invention

First of all, the problems to be solved by the invention and the effects of the invention are not limited to the above and may vary with the details of the implementation environment and configuration of the invention, and only some of the problems described above may be solved and only some of the effects described above may be achieved in some cases.

(Inter-Embodiment Relationship)

The features of each embodiment and the features according to each of the following modification examples may be mutually replaced or one feature may be added to another. For example, the web opening 40 may be formed by the method according to Embodiment 1 (with a drill or the like) at the position in the binding beam 50 where the web opening 40 is not formed after the binding beam 50 is formed by the method according to Embodiment 2 (by pre-disposition of the cylindrical form 52 in the web opening forming portion).

(Regarding Dimensions and Materials)

The dimension, shape, material, ratio, and the like of each portion of the binding beams 1 and 50 described in the detailed description of the invention and the drawings are merely examples, and any other dimensions, shapes, materials, ratios, and the like can be used as well. For example, the front-view angle that is formed by the side plate portion 13 and the bottom plate portion 12, the front-view angle that is formed by the side plate portion 13 and the flange portion 14, and the front-view angle that is formed by the flange portion 14 and the reinforcing portion 15 may be obtuse angles or acute angles although each of the angles is a right angle in each of the embodiments as illustrated in FIG. 1(*b*).

Figure 10:
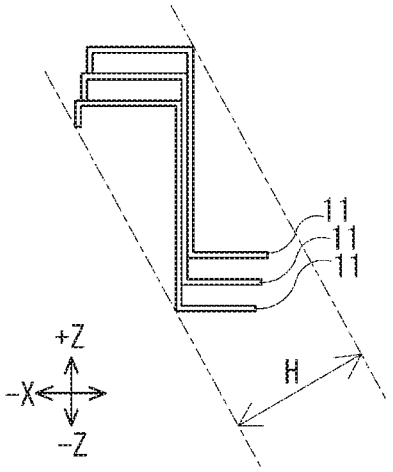
FIGS. 10(*a*) and 10(*b*) are a set of views illustrating a state where a Z-steel is transported, in which FIG. 10(*a*) is an end view illustrating the state of transport of a Z-steel of Embodiment 1 and FIG. 10(*b*) is an end view illustrating the state of transport of a Z-steel according to a first modification example.
Figure 10:
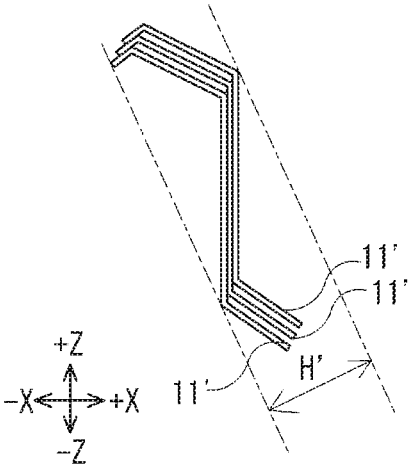

FIG. 10 is a set of views illustrating a state where the Z-steel 11 is transported. FIG. 10(*a*) is an end view illustrating the state of transport of the Z-steel 11 of Embodiment 1. FIG. 10(*b*) is an end view illustrating the state of transport of a Z-steel 11' according to a first modification example. In a state where the plurality of Z-steels 11 of Embodiment 1 are overlapped as illustrated in FIG. 10(*a*), H (hereinafter, referred to as first overlap dimension) is an interval between one of straight lines connecting a plurality of outermost portions on one side of the Z-steel 11 and the straight line that is parallel to the straight line and passes through the outermost portion of the Z-steel 11 on the other side. As illustrated in FIG. 10(*b*), the Z-steel 11' in which each of the angle formed by the side plate portion 13 and the bottom plate portion 12 and the angle formed by the side plate portion 13 and the flange portion 14 is an obtuse angle is assumed as the Z-steel 11' according to the first modification example, and in a state where a plurality of the Z-steels 11' are overlapped, H' (hereinafter, referred to as second overlap dimension) is an interval corresponding to the first overlap dimension H. The second overlap dimension H' is smaller than the first overlap dimension H. Accordingly, transport efficiency improvement can be achieved by the Z-steel 11' being formed as in FIG. 10(*b*).

Figure 11:
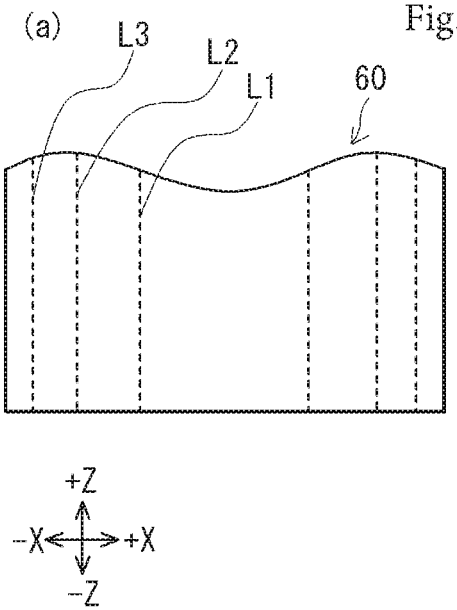
FIGS. 11(*a*) and 11(*b*) are a set of views illustrating a steel form according to a second modification example, in which FIG. 11(*a*) is a plan view of the steel form that is yet to be bent and FIG. 11(*b*) is a side view of the steel form that is bent.
Figure 11:
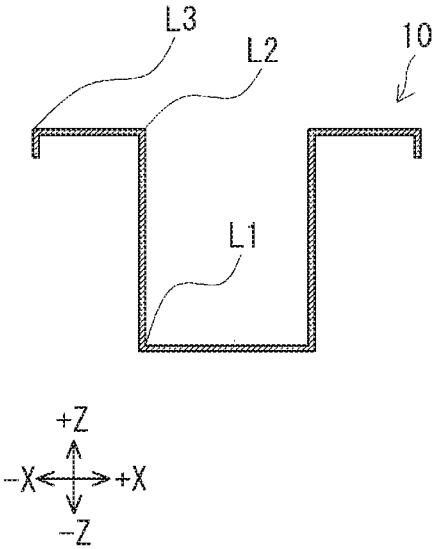

FIG. 11 is a set of views illustrating the steel form 10 according to a second modification example. FIG. 11(*a*) is a plan view of the steel form 10 that is yet to be bent. FIG. 11(*b*) is a side view of the steel form 10 that is bent. The pre-bending steel form 10 may be formed as one flat steel plate 60 as illustrated in FIG. 11(*a*). In the steel plate 60, each of a boundary line L1 between the side plate portion 13 and the bottom plate portion 12, a boundary line L2 between the side plate portion 13 and the flange portion 14, and a boundary line L3 between the flange portion 14 and the reinforcing portion 15 has a slit. The steel form 10 that is illustrated in FIG. 11(*b*) can be formed by bending each portion of the steel plate 60 in the slit by means of a known device or the like. In this case, the steel form 10 may be, for example, transported as the flat steel plate 60 in FIG. 11(*a*). Accordingly, the overlap dimension of the steel form 10 in the state of transport decreases and transportation efficiency improvement can be achieved.

Alternatively, the steel form 10 may be divided in one or more places in the longitudinal direction and joined at an installation site. The position and place of division of the steel form 10 can be determined in any manner. For example, the steel form 10 may be divided into a plurality of units capable of being loaded on a transport vehicle in terms of length. It is preferable that the position of division is a place where the moment that is applied to the post-joining steel form 10 is small. Any joining method is applicable to the steel form 10 after the division. For example, a pair of the steel forms 10 brought in touch with each other in the divided state may be connected via a connection plate (not illustrated) provided on the outside surfaces of the side plate portions 13 of the pair of steel forms 10. A drill screw: a bolt, or the like can be used for fixing of the connection plate to the side plate portion 13. In addition, when the binding beam concrete 20 is placed in the post-joining steel form 10, it is preferable to support the steel form 10 by using a temporary support at the joining point of the steel form 10. By the divided structure being adopted as described above, the manufacturing workability and the transport efficiency of the steel form 10 can be improved. In addition, even the binding beam 1 that has a large span can be built by joining of a plurality of the standard-span binding beams 1.

(Regarding Girder Joining Portion)

Figure 12:
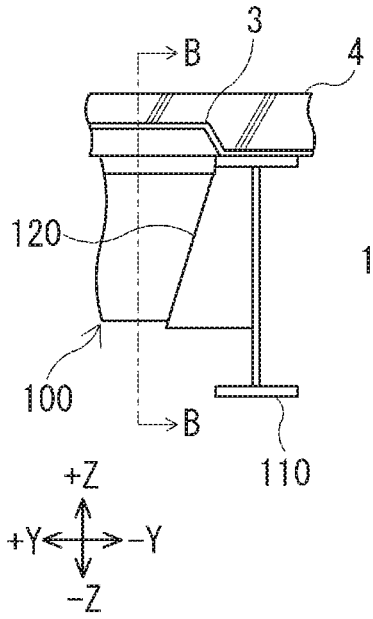
FIGS. 12(*a*) and 12(*b*) are a set of views illustrating the vicinity of the joining portion between a binding beam and a girder according to a third modification example, in which FIG. 12(*a*) is a left side view and FIG. 12(*b*) is a cross-sectional view taken along arrow B-B in FIG. 12(*a*).
Figure 12:
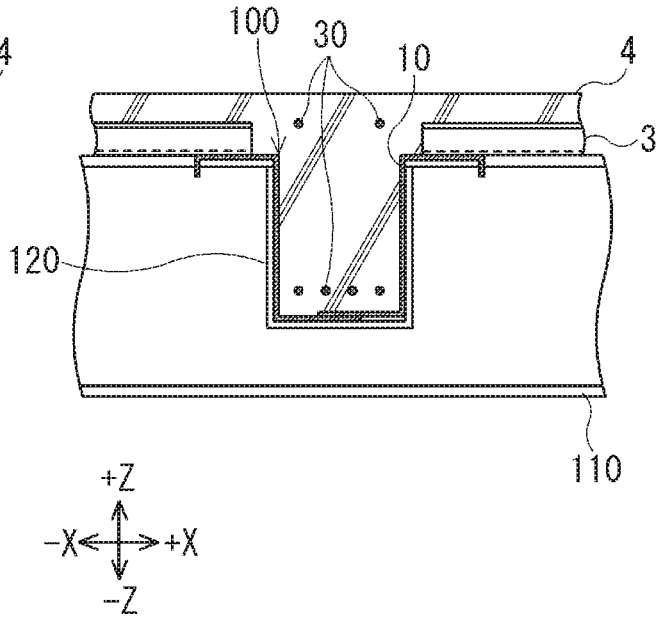

Although a case where the girder 2 is a reinforced concrete beam has been described in each embodiment, the invention is not limited thereto and the girder 2 may be, for example, a steel-framed beam. FIG. 12 is a set of views illustrating the vicinity of the joining portion between a binding beam 100 and a girder 110 according to a third modification example. FIG. 12(*a*) is a right side view and FIG. 12(*b*) is a cross-sectional view taken along arrow B-B in FIG. 12(*a*). As illustrated in FIG. 12, in the third modification example, the end portion of the binding beam 100 in the axial center direction (+Y-Y direction) is joined to the girder 110, which is a steel-framed beam. Here, a dustpan shaped member (dustpan member) 120 having a substantially U-shaped XZ cross section is joined by welding or the like to the side surface of the girder 110. The binding beam 100 and the girder 110 can be joined together by the steel form 10 of the binding beam 100 being accommodated in the dustpan shaped member 120.

Figure 13:
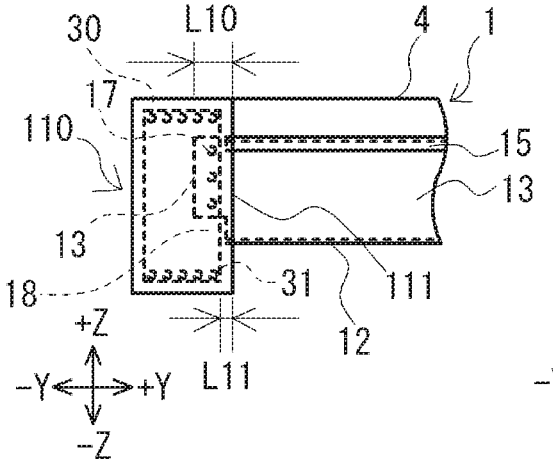
FIGS. 13(*a*) and 13(*b*) are a set of views illustrating the vicinity of the joining portion between a binding beam and a girder according to a fourth modification example, in which FIG. 13(*a*) is a right side view and FIG. 13(*b*) is a plan view.
Figure 13:
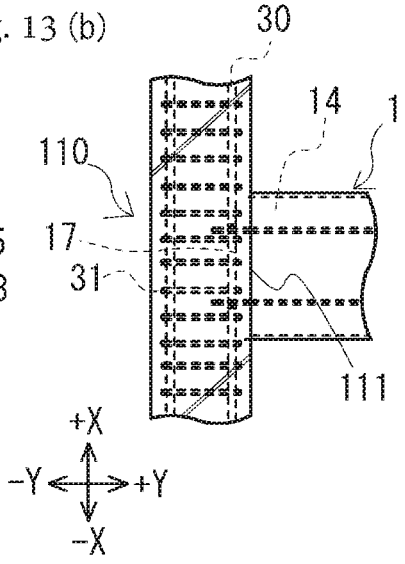

Alternatively, the swallowing width of the binding beam 1 in the girder 110 may be further increased. FIG. 13 is a set of views illustrating the vicinity of the joining portion between the binding beam 1 and the girder 110 according to a fourth modification example. FIG. 13(*a*) is a right side view and FIG. 13(*b*) is a plan view. As illustrated in FIG. 13, the girder 110 is configured as reinforced concrete and disposed in the girder 110 are a plurality of the main bars 30 disposed along the longitudinal direction of the girder 110 and a rib 31 disposed in a direction orthogonal to the longitudinal direction and surrounding the plurality of main bars 30 (in FIG. 13(*b*), only the outermost main bars 30 in the Y direction are illustrated among the main bars 30 for convenience of illustration). A notch 111 for causing the girder 110 to swallow the tip of the binding beam 1 is formed in the place in the side portion of the girder 110 that corresponds to the binding beam 1. The binding beam 1 is disposed so as to be orthogonal to the girder 110 and joined in part to the girder 110 via the notch 111. Specifically, the pair of side plate portions 13 of the binding beam 1 is accommodated in the girder 1 by a length L10, which is equal to or greater than the cover thickness of the girder 110, beyond the side surface of the girder on the binding beam 1 side whereas the bottom plate portion 12, the flange portion 14, and the reinforcing portion 15 of the binding beam 1 stay at a position where the end surface on the girder 110 side is substantially flush with the side surface of girder on the binding beam 1 side. Here, the "cover thickness" is the thickness part of concrete that reaches the rib 31 from the side surface of the girder 110 and is the thickness of a dimension L11 in FIG. 13. It is possible to further improve the joining strength of the binding beam 1 and the girder 110 by the girder 110 accommodating the binding beam 1 to the extent of the length L10, which is equal to or greater than the cover thickness L11 of the girder 110, as described above.

In the example illustrated in FIG. 13, in particular, hairpin bars 17 are swallowed by the girder 110. The hairpin bars 17 are a plurality of rod-shaped bar arrangements arranged side by side along the X direction. For the pair of side plate portions 13 swallowed by the girder 110 to be connected to each other, the hairpin bars 17 are passed through the arrangement holes (see reference numeral 13*a* in FIG. 16 to be described later) formed in the pair of side plate portions 13 and fixed by welding or the like to the pair of side plate portions 13. When the hairpin bar 17 is disposed at a position closer to the Y-direction middle position of the girder 110 than the rib 31 (position on the −Y direction side), in particular, the hairpin bar 17 and the pair of side plate portions 13 surround the rib 31 at least in part. In this structure, a movement of the hairpin bar 17 in the +Y direction is regulated by the rib 31, and thus it is possible to further improve the joining strength of the binding beam 1 and the girder 110 by means of the bearing pressure of the hairpin bar 17 (local compressive force). In the example illustrated in FIG. 13, it is assumed that in the pair of side plate portions 13, only the height part that is minimum required for disposition of a required number of the hairpin bars 17 (three in FIG. 13) is accommodated in the girder 110. Accordingly, the unnecessary height part has a notch 18 formed therein and notched. The binding beam 1 can be accommodated in the girder 110 by any method. For example, concrete placement may be performed on the steel form 10 and the form of the girder 110 in a state where the end portion of the steel form 10 is accommodated in the form of the girder 110 via the notch portion 111 formed in the form of the girder 110 and the hairpin bar 17 is disposed to surround the rib 31 at least in part and fixed to the side plate portion 13.

Figure 14:
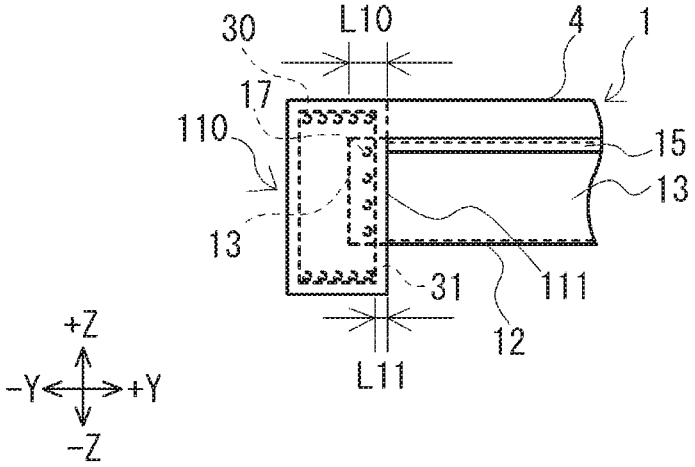
FIG. 14 is a right side view illustrating the vicinity of the joining portion between a binding beam and a girder according to a fifth modification example.

Alternatively, the pair of side plate portions 13 may be simply accommodated in the girder 110 with the height as it is and without the notch 18 being provided. FIG. 14 is a right side view illustrating the vicinity of the joining portion between the binding beam 1 and the girder 110 according to a fifth modification example (in the fifth modification example and sixth to eighth modification examples, places without description are similar to those of the fourth modification example). As illustrated in FIG. 14, in the binding beam 1, the pair of side plate portions 13 extend toward the girder 110 with the height as it is and the pair of side plate portions 13 are accommodated in the girder 110 to the extent of a length that is equal to or greater than the cover thickness of the girder 110.

Figure 15:
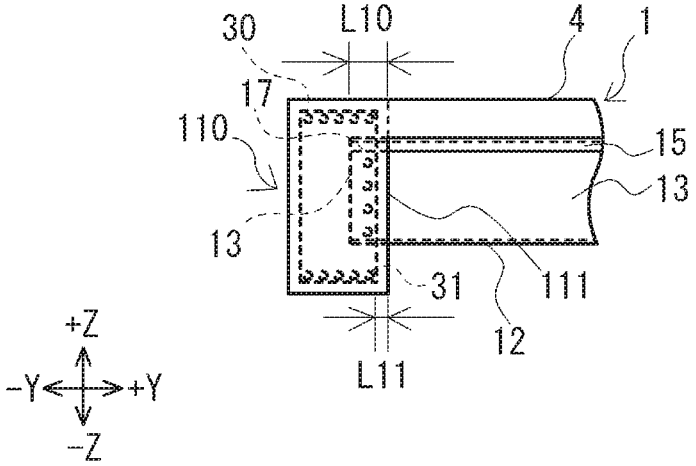
FIG. 15 is a right side view illustrating the vicinity of the joining portion between a binding beam and a girder according to a sixth modification example.
Figure 16:
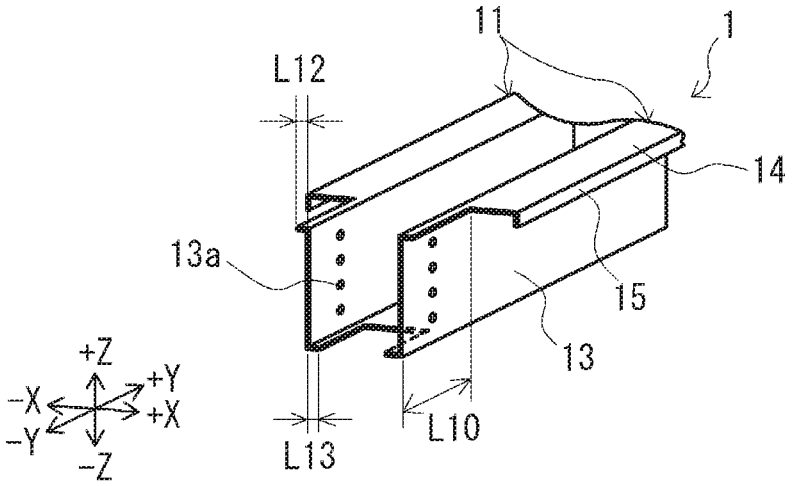
FIG. 16 is a perspective view of an end portion of the steel form of the binding beam in FIG. 15.

Alternatively, a part of the pair of side plate portions 13 and a bearing pressure effective part may be swallowed by the girder 110. FIG. 15 is a right side view illustrating the vicinity of the joining portion between the binding beam 1 and the girder 110 according to the sixth modification example. FIG. 16 is a perspective view of an end portion of the steel form 10 of the binding beam 1 in FIG. 15. As illustrated in FIGS. 15 and 16, in the binding beam 1, the pair of side plate portions 13 extend toward the girder 110 with the height as it is (or a part of the bottom plate portion 12 is notched along with a part of the reinforcing portion 15 and the flange portion 14 of the steel form 10) and the pair of side plate portions 13 are accommodated in the girder 110 to the extent of the length L10, which is equal to or greater than the cover thickness of the girder 110. In this structure, a part of the binding beam 1 accommodated in the girder 110 needs to be provided with a part receiving the bearing pressure of the hairpin bar 17 (bearing pressure effective part). The bearing pressure effective part may vary with the desired bearing pressure. For example, the width of the bearing pressure effective part is set to approximately 100 mm (=sum of an X-direction width L12, 50 mm, of a part of the flange portion 14 left without being cut and an X-direction width L13, 50 mm, of a part of the bottom plate portion 12 left without being cut). When the bearing pressure effective part has such a width, the possibility of interference with the rib 31 is low, and thus smooth swallowing into the girder 110 is possible.

Figure 17:
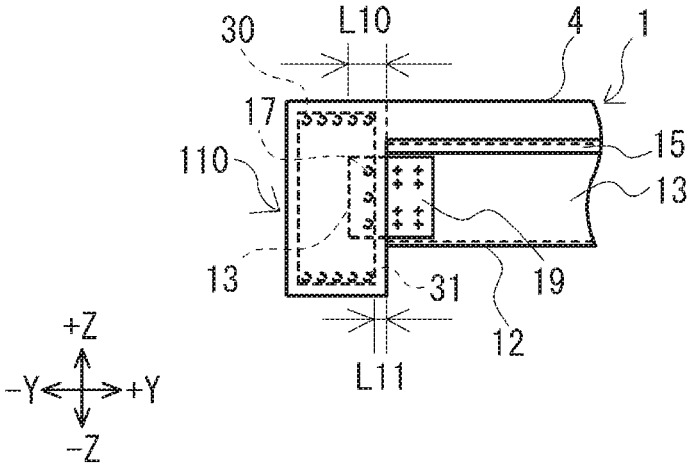
FIG. 17 is a right side view illustrating the vicinity of the joining portion between a binding beam and a girder according to a seventh modification example.

Alternatively, the part to be swallowed in the girder 110 may be retrofitted. FIG. 17 is a right side view illustrating the vicinity of the joining portion between the binding beam 1 and the girder 110 according to the seventh modification example. As illustrated in FIG. 17, the pair of side plate portions 13 in addition to the bottom plate portion 12, the flange portion 14, and the reinforcing portion 15 of the binding beam 1 has an end surface on the girder 110 side staying at a position substantially flush with the side surface of the girder 110 on the binding beam 1 side. Here, a joining plate 19 is fixed, by any method including a drill screw and a bolt, to the outside surfaces of the pair of side plate portions 13 and only the joining plate 19 is accommodated in the girder 110 by the length L11, which is equal to or greater than the cover thickness of the girder 110, beyond the side surface of the girder 110 on the binding beam 1 side. In this structure, it is not necessary to perform processing such as providing of a notch for the steel form 10 that has a complicated shape and the joining plate 19 has only to be retrofitted in the side plate portion 13, which leads to easy construction.

Figure 18:
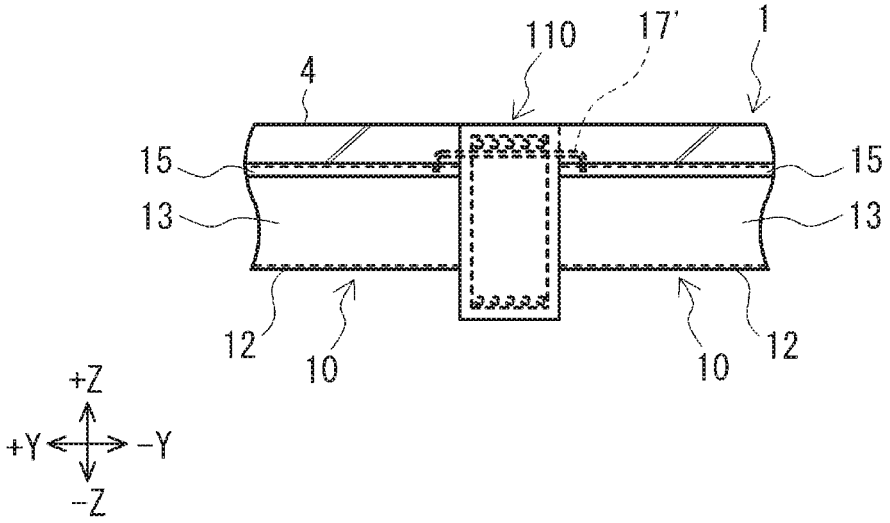
FIG. 18 is a side view illustrating the vicinity of the joining portion between a binding beam and a girder according to an eighth modification example.
Figure 19:
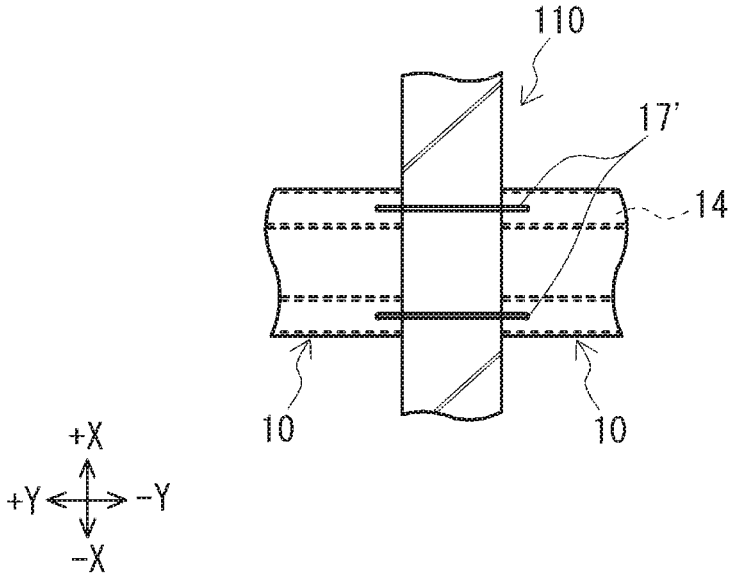
FIG. 19 is a plan view of FIG. 18.

The binding beams 1 disposed on both sides of the girder 110 may be connected to each other. FIG. 18 is a side view illustrating the vicinity of the joining portion between each binding beam 1 and the girder 110 according to the eighth modification example. FIG. 19 is a plan view of FIG. 18. As illustrated in FIGS. 18 and 19, provided on both sides of the girder 110 are the pair of binding beams 1 disposed along a direction orthogonal to the longitudinal direction of the girder 110 and the pair of binding beams 1 are disposed at positions on the same straight line that correspond to each other and brought in touch with the girder 110. The pair of binding beams 1 are connected to each other via a hairpin bar 17' fixed from above to the flange 14. Even in a case where a tensile force is applied to the binding beam 1 in a direction away from the girder 110, the hairpin bar 17' in this structure is capable of countering the tensile force.

In each of the embodiments, the binding beam concrete 20 and the girder concrete are placed at the same time. However, the invention is not limited thereto and the binding beam concrete 20 and the girder concrete may be placed one by one. In a case where the girder concrete is placed first, for example, the side surface of the solidified girder concrete may be chipped into a shape (hat shape) substantially corresponding to the axial cross-sectional shape of the binding beams 1 and 50 and the binding beam concrete 20 may be placed after the end portion of the steel form 10 of each of the binding beams 1 and 50 is installed at the chipped part.

(Regarding Flange Portion)

Although the flange portion 14 is provided in each embodiment, the flange portion 14 may be omitted and the steel form 10 may be configured as a member having a substantially U-shaped axial cross section. Although the flange portion 14 is provided at the upper end of the side plate portion 13, the invention is not limited thereto and the flange portion 14 may be provided at a position other than the upper end (such as a position that is below the upper end by a predetermined distance (such as several centimeters)).

(Regarding Reinforcing Portion)

Although the reinforcing portion 15 is provided at the outer end of the flange portion 14 in each embodiment, the reinforcing portion 15 may be omitted in a case where the flange portion 14 is capable of enduring the load of concrete. In addition, reinforcing means for further reinforcing the flange portion 14 may be provided in addition to or instead of the reinforcing portion 15. For example, reinforcement may be performed by means of a reinforcing steel plate affixed to the upper surface or the lower surface of the flange portion 14. The steel plate may be affixed through the forward-rearward direction of the flange portion 14 or may be intensively affixed only to a part particularly requiring proof stress (such as the vicinity of the middle of the flange portion 14 in the forward-rearward direction).

Figure 20:
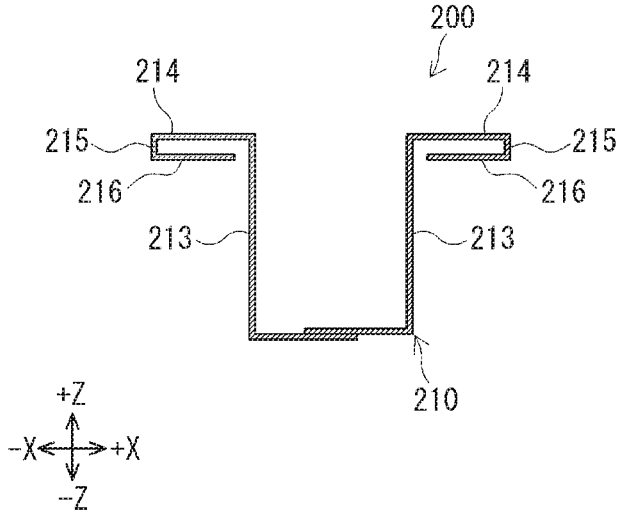
FIG. 20 is a cross-sectional view corresponding to the A-A arrow cross section in FIG. 1(*a*) and is a cross-sectional view of a steel form of a binding beam according to a ninth modification example.

Alternatively, the shape of the reinforcing portion 15 may be changed. FIG. 20 is a cross-sectional view corresponding to the A-A arrow cross section in FIG. 1(*a*) and is a cross-sectional view of a steel form 210 of a binding beam 200 according to a ninth modification example. As illustrated in FIG. 20, the steel form 210 is provided with a second reinforcing portion 216. The second reinforcing portion 216 is a steel plate extending from the lower end of a reinforcing portion 215 toward a side plate portion 213. By the second reinforcing portion 216 being provided as described above, the local buckling of the outer end of the flange portion 14 that pertains to a case where the slab concrete 4 is placed and a flange portion 214 receives the load of a slab can be more effectively deterred. In addition, it is possible to reduce the overall thickness of the steel form 210 by locally reinforcing only a low-strength part by means of the second reinforcing portion 216.

Figure 21:
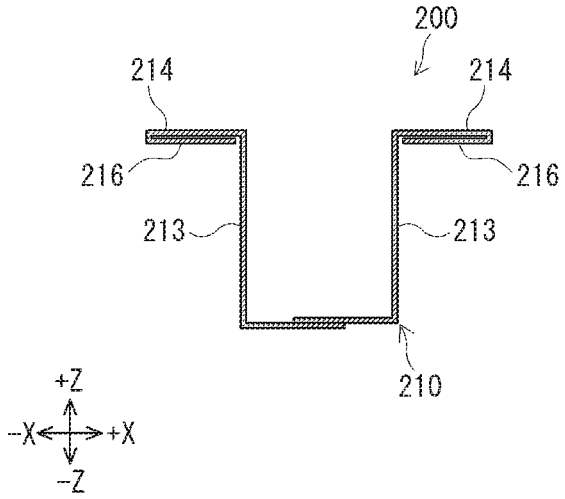
FIG. 21 is a cross-sectional view corresponding to the A-A arrow cross section in FIG. 1(*a*) and is a cross-sectional view of a steel form of a binding beam according to a tenth modification example.

The second reinforcing portion 216 can be provided in another aspect as well. FIG. 21 is a cross-sectional view corresponding to the A-A arrow cross section in FIG. 1(*a*) and is a cross-sectional view of the steel form 210 of the binding beam 200 according to a tenth modification example. In the example illustrated in FIG. 21, the second reinforcing portion 216 is formed by the outer end of the flange portion 214 being folded back toward the side plate portion 213 and the reinforcing portion 215 is omitted.

(Regarding Z-Steel)

Figure 22:
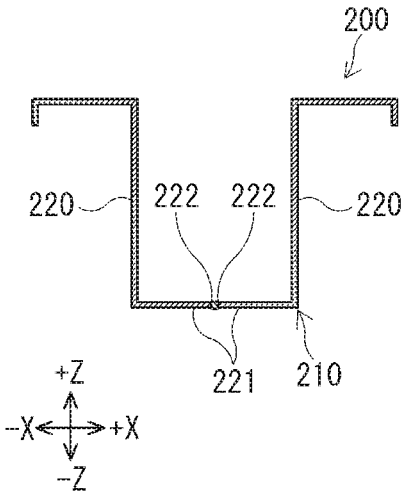
FIGS. 22(*a*) and 22(*b*) are a set of cross-sectional views corresponding to the A-A arrow cross section in FIG. 1(*a*), in which FIG. 22(*a*) illustrates a steel form of a binding beam according to an eleventh modification example and FIG. 22(*b*) illustrates a steel form of a binding beam according to a twelfth modification example.
Figure 22:
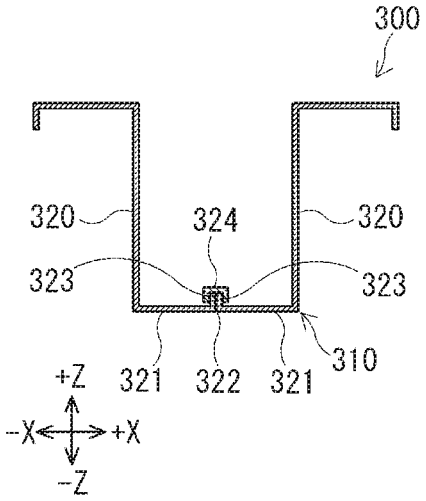

In each embodiment, the pair of Z-steels 11 are overlapped with each other and bolt-joined. Specific methods for the joining are not limited thereto. FIG. 22 is a set of cross-sectional views corresponding to the A-A arrow cross section in FIG. 1(*a*). FIG. 22(*a*) is a cross-sectional view of the steel form 210 of the binding beam 200 according to an eleventh modification example. FIG. 22(*b*) is a cross-sectional view of a steel form 310 of a binding beam 300 according to a twelfth modification example. In other words, as illustrated in FIG. 22(*a*), the surfaces of bottom plate portions 221 of a pair of Z-steels 220 that are brought in touch with each other may be used as joining surfaces 222 and the surfaces may be joined by welding. Alternatively, as illustrated in FIG. 22(*b*), end portions of bottom plate portions 321 of a pair of Z-steels 320 may be folded back upward, the inside surface of this folded part 322 may be combined as a joining surface 323, and the folded part may be joined by means of a caulking fitting 324 in that state. Alternatively, drill screw or screw driving may be performed from below or above on the end portions of the bottom plate portions 321 of the pair of Z-steels 320 so that the end portions are joined to each other. In this case, the drill screw or the screw may be allowed to protrude by, for example, approximately several centimeters into the inner spaces of the pair of Z-steels 220 so that the joining strength between the Z-steel 220 and the binding beam concrete 20 placed in the inner space is further enhanced.

(Regarding Non-Opening Member)

Figure 23:
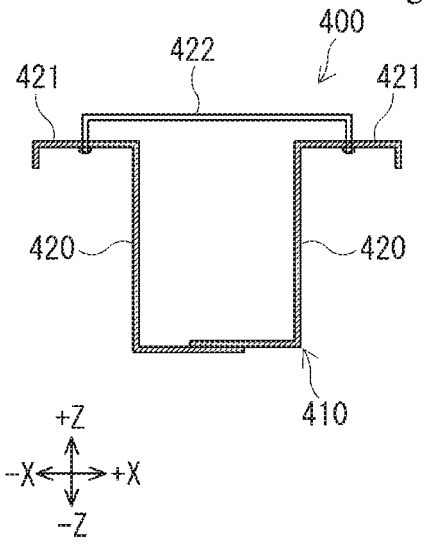
FIGS. 23(*a*) and 23(*b*) are a set of cross-sectional views corresponding to the A-A arrow cross section in FIG. 1(*a*), in which FIG. 23(*a*) illustrates a steel form of a binding beam according to a thirteenth modification example and FIG. 23(*b*) illustrates a steel form of a binding beam according to a fourteenth modification example.
Figure 23:
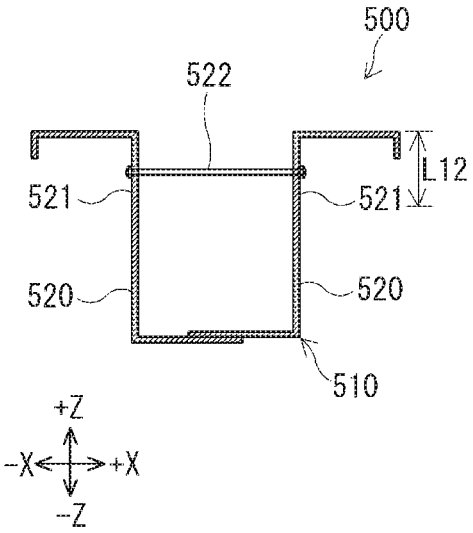

A point that has been described in each embodiment is that a temporary member (member removed before concrete placement) such as a batten and a U-shaped veneer board is provided for fixing of the relative positions of the pair of Z-steels 11 during the formation of the steel form 10 (mutual joining of the pair of Z-steels 11). A permanent member for fixing the relative positions of the pair of Z-steels 11 (member embedded without pre-concrete placement removal, hereinafter, referred to as non-opening member) may be provided instead of or in addition to the temporary member. FIG. 23 is a set of cross-sectional views corresponding to the A-A arrow cross section in FIG. 1(*a*). FIG. 23(*a*) illustrates a steel form 410 of a binding beam 400 according to a thirteenth modification example. FIG. 23(*b*) illustrates a steel form 510 of a binding beam 500 according to a fourteenth modification example. In other words, a non-opening member 422 may be provided for connection between flange portions 421 of a pair of Z-steels 420 as illustrated in FIG. 23(*a*) or a non-opening member 522 may be provided for connection between side plate portions 521 of a pair of Z-steels 520 as illustrated in FIG. 23(*b*). When the relative positions of the pairs of Z-steels 420 and 520 are fixed by means of the non-opening members 422 and 522, it is possible to prevent the pairs of Z-steels 420 and 520 from mutually opening outward due to the weight of the binding beam concrete 20 after the placement of the binding beam concrete 20.

The non-opening member 522 illustrated in FIG. 23(*b*), in particular, is preferably provided in the range (range of the dimension L12 in FIG. 23(*b*)) from the upper end positions of the pair of side plate portions to the position that is below the upper end positions by one-third of the height of the pair of side plate portions. In a case where the pairs of Z-steels 420 and 520 are likely to mutually open outward, the side plate portion 13 is likely to pivot to the outside with the boundary between the bottom plate portion 12 and the side plate portion 13 as a fulcrum, and thus the distance between the pair of side plate portions 13 tends to increase as the upper end of the side plate portion 13 is approached. By the non-opening member 522 being provided in the above-described range, however, the relative positions of the pair of side plate portions 13 can be fixed at a position relatively close to the upper ends of the pair of side plate portions 13, and thus the mutual outward opening of the pair of side plate portions 13 can be more effectively prevented than in a case where the non-opening member 522 is provided at a position below the range.

(Regarding Main Bar Arrangement Step)

In each embodiment, the main bar arrangement step is performed after the steel form installation step. However, the invention is not limited thereto and the steel form installation step may be performed after the main bar arrangement step. At this time, the main bar 30 is disposed first in the main bar arrangement step, the pair of Z-steels 11 are disposed so as to cover the main bar 30 from below, and in a state where the bottom plate portions 12 of the pair of Z-steels 11 overlap each other, a bolt being inserted from below through the bottom plate portion 12 and thereby the pair of Z-steels 11 may be joined to each other.

One embodiment of the present invention provides a steel-framed concrete beam comprises: a steel form having a bottom plate portion and a pair of side plate portions extending upward from both ends of the bottom plate portion: and concrete placed in a groove portion configured by the bottom plate portion and the pair of side plate portions of the steel form.

According to this embodiment, since an outer shell of the concrete is covered by the steel form, it is possible to suppress a decline in proof stress during the formation of a web opening in the side surface of the beam and it is possible to reduce the labor and cost entailed by separate reinforcing member attachment for forming the web opening.

Another embodiment of the present invention provides the steel-framed concrete beam according to the above embodiment, wherein an allowable bending moment or an allowable shear force of the steel-framed concrete beam is calculated by Equation (1) below: (Equation 1) $F_a=F_{RC}+\beta\cdot F_S$ wherein, $F_a$: an allowable bending moment or an allowable shear force of the steel-framed concrete beam, $F_{RC}$: an allowable bending moment or an allowable shear force of the concrete, β: a burden factor of an allowable bending moment or an allowable shear force of the steel form, which is 0.5 or less, and $F_S$: an allowable bending moment or an allowable shear force of the steel form.

According to this embodiment, it is possible to calculate a complex allowable bending moment and a complex allowable shear force taking the respective bearing ratios of the steel form and the concrete into account and it is possible to optimize the design of the steel-framed concrete beam.

Another embodiment of the present invention provides the steel-framed concrete beam according to the above embodiment, wherein a part of the steel-framed concrete beam is joined to a girder, and the steel form is provided with an end portion on the girder side in a longitudinal direction of the steel form, accommodated in the girder via a notch formed in a side surface of the girder, and having a length equal to or greater than a cover thickness of the girder.

According to this embodiment, it is possible to further improve the joining strength of a binding beam and a girder by the girder accommodating the binding beam to the extent of the length, which is equal to or greater than the cover thickness of the girder.

Another embodiment of the present invention provides the steel-framed concrete beam according to the above embodiment, wherein the side plate portion and the concrete have a web opening forming portion allowing formation of a web opening penetrating the side plate portion and the concrete.

According to this embodiment, since the web opening can be formed in the web opening forming portion, piping and wiring and so on can be passed through the web opening, and the convenience of the steel-framed concrete beam can be enhanced. In particular, since an outer shell of the concrete of the steel-framed concrete beam is covered by the steel form, a part where the web opening can be formed is not limited to a part of reinforcing member attachment unlike in the related art, and the degree of freedom of the size and disposition of the web opening can be enhanced Another embodiment of the present invention provides the steel-framed concrete beam according to the above embodiment, wherein a non-opening member for fixing the pair of side plate portions to each other is provided in a range from an upper end position of the pair of side plate portions to a position below the upper end position by one-third of a height of the pair of side plate portions.

According to this embodiment, since relative positions of the pair of side plate portions can be fixed at a position relatively close to the upper end position of the pair of side plate portions, mutual outward opening of the pair of side plate portions can be more effectively prevented than in a case where the non-opening member is provided at a position below this range.

Another embodiment of the present invention provides the steel-framed concrete beam according to the above embodiment, wherein the steel form is provided with a flange portion extending outward from an upper end of the side plate portion.

According to this embodiment, since the flange portion is provided, load of a slab supported by the steel-framed concrete beam can be received by the flange portion and is allowed to smoothly flow to the steel-framed concrete beam and proof stress of the steel-framed concrete beam is improved.

Another embodiment of the present invention provides the steel-framed concrete beam according to the above embodiment, wherein the steel form is provided with a reinforcing portion extending downward or upward from an outer end of the flange portion.

According to this embodiment, since the reinforcing portion is provided at the outer end of the flange portion, buckling of the flange portion at a time when the concrete is placed on the groove portion or the flange portion of the steel form can be suppressed by the reinforcing portion and the proof stress of the steel-framed concrete beam is improved.

Another embodiment of the present invention provides a method for constructing a steel-framed concrete comprises: a steel form installation step of installing a steel form having a bottom plate portion and a pair of side plate portions extending upward from both ends of the bottom plate portion; and a placement step of placing concrete in a groove portion configured by the bottom plate portion and the pair of side plate portions of the steel form installed in the steel form installation step.

According to this embodiment, since an outer shell of the concrete is covered by the steel form, it is possible to suppress a decline in proof stress during the formation of a web opening in the side surface of the beam and it is possible to reduce the labor and cost entailed by separate reinforcing member attachment for forming the web opening.

Another embodiment of the present invention provides the method for constructing a steel-framed concrete beam according to the above embodiment, wherein an allowable bending moment or an allowable shear force of the steel-framed concrete beam is calculated by Equation (1) below: (Equation 1) $F_a=F_{RC}+\beta\cdot F_S$ wherein, $F_a$: an allowable bending moment or an allowable shear force of the steel-framed concrete beam, $F_{RC}$: an allowable bending moment or an allowable shear force of the concrete, β: a burden factor of an allowable bending moment or an allowable shear force of the steel form, which is 0.5 or less, and $F_S$: an allowable bending moment or an allowable shear force of the steel form.

According to this embodiment, it is possible to calculate a complex allowable bending moment and a complex allowable shear force taking the respective bearing ratios of the steel form and the concrete into account and it is possible to optimize the design of the steel-framed concrete beam.

REFERENCE SIGNS LIST

1 Binding beam
2 Girder
2*a* Wooden form
2*b* Binding beam accommodating portion
2*c* Flange accommodating portion
2*d* Sealing material
3 Deck plate
4 Slab concrete
10 Steel form
11, 11' Z-steel
12 Bottom plate portion
13 Side plate portion
13*a* Arrangement hole
14 Flange portion
15 Reinforcing portion
16 Joining surface
17, 17' Hairpin bar
18 Notch
19 Joining plate
20 Binding beam concrete
30 Main bar
31 Rib
40 Web opening
50 Binding beam
51 Circular hole
52 Cylindrical form
60 Steel plate
100 Binding beam
110 Girder
111 Notch
120 Dustpan shaped member
200 Binding beam
210 Steel form
213 Side plate portion
214 Flange portion
215 Reinforcing portion
216 Second reinforcing portion
220 Z-steel
221 Bottom plate portion
222 Joining surface
300 Binding beam
310 Steel form
320 Z-steel
321 Bottom plate portion
322 Folded part
323 Joining surface
324 Caulking fitting
400 Binding beam
410 Steel form
420 Z-steel
421 Flange portion
422 Non-opening member
500 Binding beam
510 Steel form
520 Z-steel
521 Side plate portion
522 Non-opening member

The invention claimed is:

1. A steel-framed concrete beam comprising:

a steel form having a bottom plate portion and a pair of side plate portions extending upward from both ends of the bottom plate portion; and concrete placed in a groove portion configured by the bottom plate portion and the pair of side plate portions of the steel form, wherein an allowable bending moment or an allowable shear force of the steel-framed concrete beam is calculated by Equation (1) below:

$$F_a = F_{RC} + \beta \cdot F_S \quad \text{(Equation 1)}$$

wherein, $F_a$: an allowable bending moment or an allowable shear force of the steel-framed concrete beam, $F_{RC}$: an allowable bending moment or an allowable shear force of the concrete, $\beta$: a burden factor of an allowable bending moment or an allowable shear force of the steel form, which is 0.5 or less, and $F_S$: an allowable bending moment or an allowable shear force of the steel form.

2. The steel-framed concrete beam according to claim 1, wherein a part of the steel-framed concrete beam is joined to a girder, and the steel form is provided with an end portion on the girder side in a longitudinal direction of the steel form, accommodated in the girder via a notch formed in a side surface of the girder, and having a length equal to or greater than a cover thickness of the girder.

3. The steel-framed concrete beam according to claim 1, wherein the side plate portion and the concrete have a web opening forming portion allowing formation of a web opening penetrating the side plate portion and the concrete.

4. The steel-framed concrete beam according to claim 1, wherein a non-opening member for fixing the pair of side plate portions to each other is provided in a range from an upper end position of the pair of side plate portions to a position below the upper end position by one-third of a height of the pair of side plate portions.

5. The steel-framed concrete beam according to claim 1, wherein the steel form is provided with a flange portion extending outward from an upper end of the side plate portion.

6. The steel-framed concrete beam according to claim 5, wherein the steel form is provided with a reinforcing portion extending downward or upward from an outer end of the flange portion.

7. A method for constructing a steel-framed concrete beam comprising:

a steel form installation comprising installing a steel form having a bottom plate portion and a pair of side plate portions extending upward from both ends of the bottom plate portion; and a placement comprising placing concrete in a groove portion configured by the bottom plate portion and the pair of side plate portions of the steel form installed in the steel form installation, wherein an allowable bending moment or an allowable shear force of the steel-framed concrete beam is calculated by Equation (1) below:

$$F_a = F_{RC} + \beta \cdot F_S \quad \text{(Equation 1)}$$

wherein, $F_a$: an allowable bending moment or an allowable shear force of the steel-framed concrete beam, $F_{RC}$: an allowable bending moment or an allowable shear force of the concrete, $\beta$: a burden factor of an allowable bending moment or an allowable shear force of the steel form, which is 0.5 or less, and $F_S$: an allowable bending moment or an allowable shear force of the steel form.

8. The steel form according to claim 1, wherein a joining surface of the bottom plate portion is formed by superposing a part of the bottom plate portion of a first of a pair of frame members of the steel form and a part of the bottom plate portion of a second of the pair of frame members over each other.

* * * * *